US012371874B2

(12) United States Patent
Nakamura et al.

(10) Patent No.: US 12,371,874 B2
(45) Date of Patent: Jul. 29, 2025

(54) WORK MACHINE

(71) Applicant: HITACHI CONSTRUCTION MACHINERY CO., LTD., Tokyo (JP)

(72) Inventors: Satoshi Nakamura, Tokyo (JP); Kouji Shiwaku, Tsuchiura (JP); Shinya Imura, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 231 days.

(21) Appl. No.: 18/022,812

(22) PCT Filed: Nov. 12, 2021

(86) PCT No.: PCT/JP2021/041803
§ 371 (c)(1),
(2) Date: Feb. 23, 2023

(87) PCT Pub. No.: WO2022/124008
PCT Pub. Date: Jun. 16, 2022

(65) Prior Publication Data

US 2023/0392347 A1 Dec. 7, 2023

(30) Foreign Application Priority Data

Dec. 7, 2020 (JP) ..... 2020-202727

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 9/2203* (2013.01); *E02F 9/262* (2013.01);
(Continued)

(58) Field of Classification Search
CPC ..... E02F 3/439
See application file for complete search history.

(56) References Cited

U.S. PATENT DOCUMENTS 10,036,141 B2 * 7/2018 Yokoo ..... E02F 9/265
11,230,824 B2 * 1/2022 Narikawa ..... E02F 9/262
(Continued)

FOREIGN PATENT DOCUMENTS

JP 2019-052515 A 4/2019
JP 2019-090185 A 6/2019
(Continued)

OTHER PUBLICATIONS

International Search Report of PCT/JP2021/041803 dated Dec. 28, 2021.
(Continued)

*Primary Examiner* — Michael A Berns
(74) *Attorney, Agent, or Firm* — MATTINGLY & MALUR, PC

(57) ABSTRACT

A working status indicating a status related to the present work of a hydraulic excavator 1 is determined on the basis of operation signals output from a control lever 24, posture information output from inertial measuring devices 27 to 30, load information output from pressure sensors 32 and 33, and a work area set by a display input device 26, an operation form indicating contents of an operation in operation correction control of a front work implement 12 is decided from a plurality of operation forms set in advance, according to the determined working status, and the operation correction control is performed such that the front work implement moves according to the operation form. Thus, an appropriate assisting operation can be performed in machine control, so that the work accuracy can be improved.

5 Claims, 18 Drawing Sheets

(51) Int. Cl.
*E02F 9/22* (2006.01)
*E02F 9/26* (2006.01)

(52) U.S. Cl.
CPC ..... *E02F 9/2285* (2013.01); *E02F 9/2292* (2013.01); *E02F 9/2296* (2013.01)

(56) References Cited

U.S. PATENT DOCUMENTS

| | | | | |
|---|---|---|---|---|
| 11,414,839 | B2 * | 8/2022 | Shintani | B60K 35/00 |
| 11,668,069 | B2 * | 6/2023 | Ishihara | E02F 9/2203 701/50 |
| 11,885,097 | B2 * | 1/2024 | Meguriya | G06Q 10/063 |
| 2017/0292247 | A1 | 10/2017 | Yokoo et al. | |
| 2020/0141091 | A1 | 5/2020 | Narikawa et al. | |
| 2021/0040705 | A1 | 2/2021 | Ishihara et al. | |
| 2021/0332566 | A1 | 10/2021 | Shintani et al. | |
| 2022/0025608 | A1 | 1/2022 | Itoh et al. | |
| 2022/0056663 | A1 | 2/2022 | Meguriya et al. | |
| 2023/0304261 | A1 * | 9/2023 | Ishii | E02F 3/437 |
| 2023/0392347 | A1 * | 12/2023 | Nakamura | E02F 9/262 |

FOREIGN PATENT DOCUMENTS

| | | | |
|---|---|---|---|
| JP | 2020-159049 | A | 10/2020 |
| JP | 2020-159056 | A | 10/2020 |
| WO | 2016/148311 | A1 | 9/2016 |
| WO | 2019/049309 | A1 | 3/2019 |

OTHER PUBLICATIONS

International Preliminary Report on Patentability received in corresponding International Application No. PCT/JP2021/041803 dated Jun. 22, 2023.

* cited by examiner

WORK MACHINE

TECHNICAL FIELD

The present invention relates to a work machine.

BACKGROUND ART

As a technology for improving work efficiency of a work machine typified by a hydraulic excavator, machine control (MC) is known which semiautomatically controls the operation of a work device (for example, a work device including a boom, an arm, and a bucket) according to an operation made by an operator of the work device who operates an operation device and conditions determined in advance. The machine control (hereinafter referred to simply as MC) assists the operator to operate the work device by, for example, maintaining a distal end position of the bucket in the work device at a distance determined in advance with respect to a target surface or maintaining the posture (angle) of the bucket at an angle determined in advance with respect to the target surface.

As a technology related to MC settings, Patent Document 1, for example, discloses a control system for a work vehicle having a work implement (work device). The work vehicle control system includes a first control lever of the work implement, a first operating member provided to the first control lever, and a controller that performs automatic control of the work implement. The controller performs the function of the automatic control assigned to the first operating member, according to an operation of the first operating member, when execution conditions including a condition that the first control lever is at a neutral position are satisfied.

PRIOR ART DOCUMENT

Patent Document

Patent Document 1: PCT Patent Publication No. WO2016/148311

SUMMARY OF THE INVENTION

Problems to be Solved by the Invention

In order to achieve appropriate operation assistance in MC, it is necessary to switch between the enabling and disabling of MC according to work contents and a work environment and set appropriate assistance contents, for example. In the conventional technology, the operator alternately selects the enabling and disabling of the automatic control by operating the operating member provided to the control lever. In such a case, however, if the operator forgets to operate the operating member, work may be performed while the automatic control is disabled. Consequently, excavation may possibly be performed beyond a design surface. In addition, when the work contents are set through an operation made by the operator, if the operator sets the work contents or the assistance contents erroneously, the work device may not be set in a desired posture. As a result, the work device may erroneously excavate a construction surface excessively or drop soil transported to the construction surface, so that sufficient work accuracy may not be obtained. That is, in the case as described above, an appropriate MC operation may be unable to be performed, and thus, the work accuracy may be decreased.

The present invention has been made in view of the above. It is an object of the present invention to provide a work machine that can perform an appropriate assisting operation in the machine control and consequently improve the work accuracy.

Means for Solving the Problems

The present application includes a plurality of pieces of means for solving the above-described problems. As an example of the means, there is provided a work machine including a lower track structure, an upper swing structure that is swingable with respect to the lower track structure, an articulated front work implement that is attached to the upper swing structure and includes a plurality of front implement members rotatably coupled together, an operation device that outputs operation signals for driving the upper swing structure and the front work implement according to amounts of operations made by an operator, a plurality of front work implement actuators that individually drive the plurality of front implement members on the basis of driving signals generated according to the operation signals output from the operation device, a swing actuator that swing-drives the upper swing structure on the basis of the operation signal output from the operation device, a posture information sensor that senses posture information as information regarding postures of the upper swing structure and the front work implement, and a controller that performs operation correction control to output a driving signal to at least one of the plurality of front work implement actuators such that the front work implement is set in a predetermined position or posture on a predetermined target surface and within one area with respect to the target surface, on the basis of the operation signals output from the operation device and the posture information sensed by the posture information sensor. The work machine further includes a load information sensor that senses load information as information regarding a load on at least one hydraulic actuator of the plurality of front work implement actuators, and a work area setting device that sets a work area over the predetermined target surface. The controller determines a working status indicating a status related to present work of the work machine, on the basis of the operation signals output from the operation device, the posture information sensed by the posture information sensor, the load information sensed by the load information sensor, and the work area set by the work area setting device, decides an operation form indicating contents of an operation in the operation correction control of the front work implement, from a plurality of operation forms set in advance, according to the determined working status, and performs the operation correction control such that the front work implement moves according to the operation form.

Advantages of the Invention

According to the present invention, it is possible to perform an appropriate assisting operation in machine control and consequently improve the work accuracy.

MODES FOR CARRYING OUT THE INVENTION

Embodiments of the present invention will hereinafter be described with reference to the drawings. It is to be noted that, while a hydraulic excavator mounted with an articulated front work implement will be illustrated and described as an example of a work machine in the embodiments, the present invention is also applicable to other work machines provided with a front work implement.

First Embodiment

A first embodiment of the present invention will be described with reference to FIGS. 1 to 17.

Figure 1:
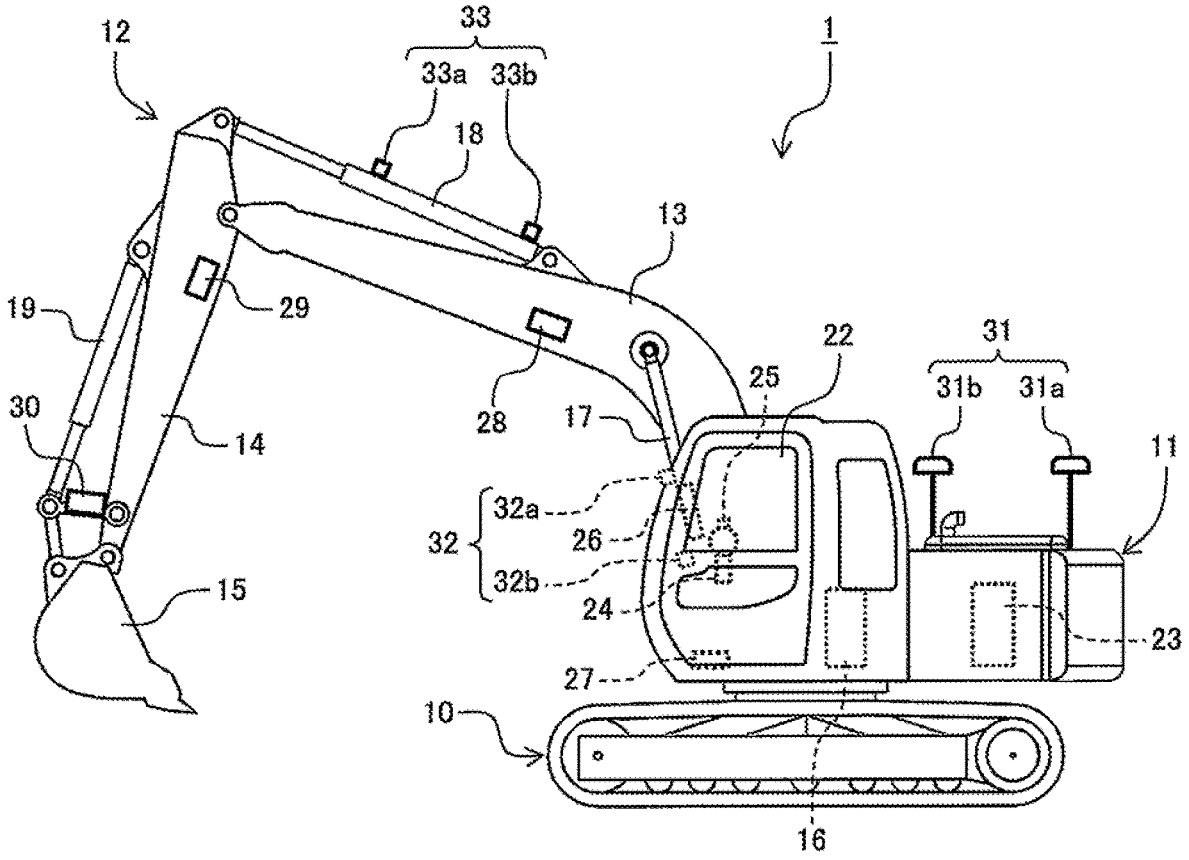
FIG. 1 is a diagram schematically illustrating an external appearance of a hydraulic excavator as an example of a work machine.

FIG. 1 is a diagram schematically illustrating an external appearance of a hydraulic excavator as an example of a work machine according to the present embodiment.

In FIG. 1, a hydraulic excavator 1 essentially includes a lower track structure 10, an upper swing structure 11 swingably provided to the lower track structure 10, a front work implement 12 rotatably provided to the upper swing structure 11, and an operation room 22 where an operator operates the machine.

The front work implement 12 is of an articulated type and includes a plurality of front implement members (a boom 13, an arm 14, and a bucket (work tool) 15) that each rotate in a vertical direction and that are coupled together. A proximal end of the boom 13 is supported by a front portion of the upper swing structure 11 rotatably in the vertical direction. One end of the arm 14 is supported by an end portion (distal end) of the boom 13, which is opposite to the proximal end of the boom 13, rotatably in the vertical direction. The bucket 15 as a work tool is supported by the other end of the arm 14 rotatably in the vertical direction.

The boom 13, the arm 14, and the bucket 15 are rotationally driven by a boom cylinder 17, an arm cylinder 18, and a bucket cylinder 19, respectively, which are hydraulic actuators (front work implement actuators). Further, the upper swing structure 11 is swing-driven by a swing hydraulic motor 16 which is a hydraulic actuator (swing actuator). In addition, the lower track structure 10 is travel-driven by left and right travelling hydraulic motors, not illustrated, which are hydraulic actuators (travelling actuators).

The boom cylinder 17 includes a pressure sensor 32*a* and a pressure sensor 32*b* that serve as load information sensors for sensing load information as information regarding a load on the hydraulic actuator. The pressure sensor 32*a* senses a hydraulic pressure on a rod side, and the pressure sensor 32*b* senses a hydraulic pressure on a bottom side. Similarly, the arm cylinder 18 includes a pressure sensor 33*a* and a pressure sensor 33*b* that serve as the load information sensors. The pressure sensor 33*a* senses a pressure on a rod side, and the pressure sensor 33*b* senses a pressure on a bottom side. Hereinafter, the pressure sensors 32*a* and 32*b* and the pressure sensors 33*a* and 33*b* may collectively be referred to as a pressure sensor 32 and a pressure sensor 33, respectively.

In the operation room 22, control levers 24*a* and 24*b* (see FIG. 2) which are operation devices, a controller 23, and a display input device 26 are arranged. The controller 23 controls the whole operation of the hydraulic excavator 1. The display input device 26 displays information for the operator and receives an instruction input from the operator. Hereinafter, the two control levers 24*a* and 24*b* may collectively be referred to as a control lever 24.

The controller 23 is constituted by a central processing unit (CPU), a memory, and an interface. The CPU executes a program stored in the memory in advance and performs processing on the basis of set values stored in the memory and a signal input from the interface. Then, the interface outputs a signal.

The display input device 26 is, for example, a pointing device such as a touch panel. The display input device 26 displays information and receives an instruction from the operator through a graphical user interface (GUI) displayed on a screen.

The upper swing structure 11, the boom 13, the arm 14, and the bucket 15 have inertial measuring devices (inertial measurement units (IMUs)) 27, 28, 29, and 30, respectively. Each of the inertial measuring devices serves as a posture information sensor for sensing posture information as information regarding the posture of a corresponding one of the members. Hereinafter, when there is a need to distinguish these inertial measuring devices from one another, the respective inertial measuring devices will be referred to as a machine body inertial measuring device 27, a boom inertial measuring device 28, an arm inertial measuring device 29, and a bucket inertial measuring device 30. The relative positions where the inertial measuring devices 27, 28, 29, and 30 are attached to the respective members can be obtained from design information or the like. Thus, the relative rotational angles of the upper swing structure 11, the boom 13, the arm 14, and the bucket 15 can be estimated on the basis of sensing results (angular velocities and accelerations) from the inertial measuring devices 27, 28, 29, and 30.

In addition, two global navigation satellite system (GNSS) antennas 31*a* and 31*b* which are positional information sensors for sensing positional information are attached to an upper portion of the upper swing structure 11. Each of the GNSS antennas 31*a* and 31*b* has a position computing function of computing a signal received from an artificial satellite, to thereby compute the positional information. The GNSS antennas 31*a* and 31*b* can estimate the azimuth (orientation) of the upper swing structure 11 from a difference between the positional information obtained by the GNSS antenna 31*a* and the positional information obtained by the GNSS antenna 31*b*. Hereinafter, the two GNSS antennas 31*a* and 31*b* may collectively be referred to as a GNSS antenna 31.

The control lever 24 disposed in the operation room 22 includes the two control levers 24*a* and 24*b* that are swingable forward, rearward, leftward, and rightward. Each of the two control levers 24*a* and 24*b* of the control lever 24 is capable of receiving, as input, operation amounts of a total of four axial swings in a forward-rearward direction and a left-right direction. By generating driving signals in the controller 23 on the basis of operation signals generated according to the operation amounts of swinging operations of the control lever 24, it is possible to drive the swing hydraulic motor 16, the boom cylinder 17, the arm cylinder 18, and the bucket cylinder 19 individually according to the operations of the control lever 24. In addition, operation buttons 25*a* and 25*b* (see FIG. 2) that can receive operation input through depression by the operator are provided on the control levers 24*a* and 24*b*, respectively. Hereinafter, the two operation buttons 25*a* and 25*b* may collectively be referred to as an operation button 25.

Figure 2:
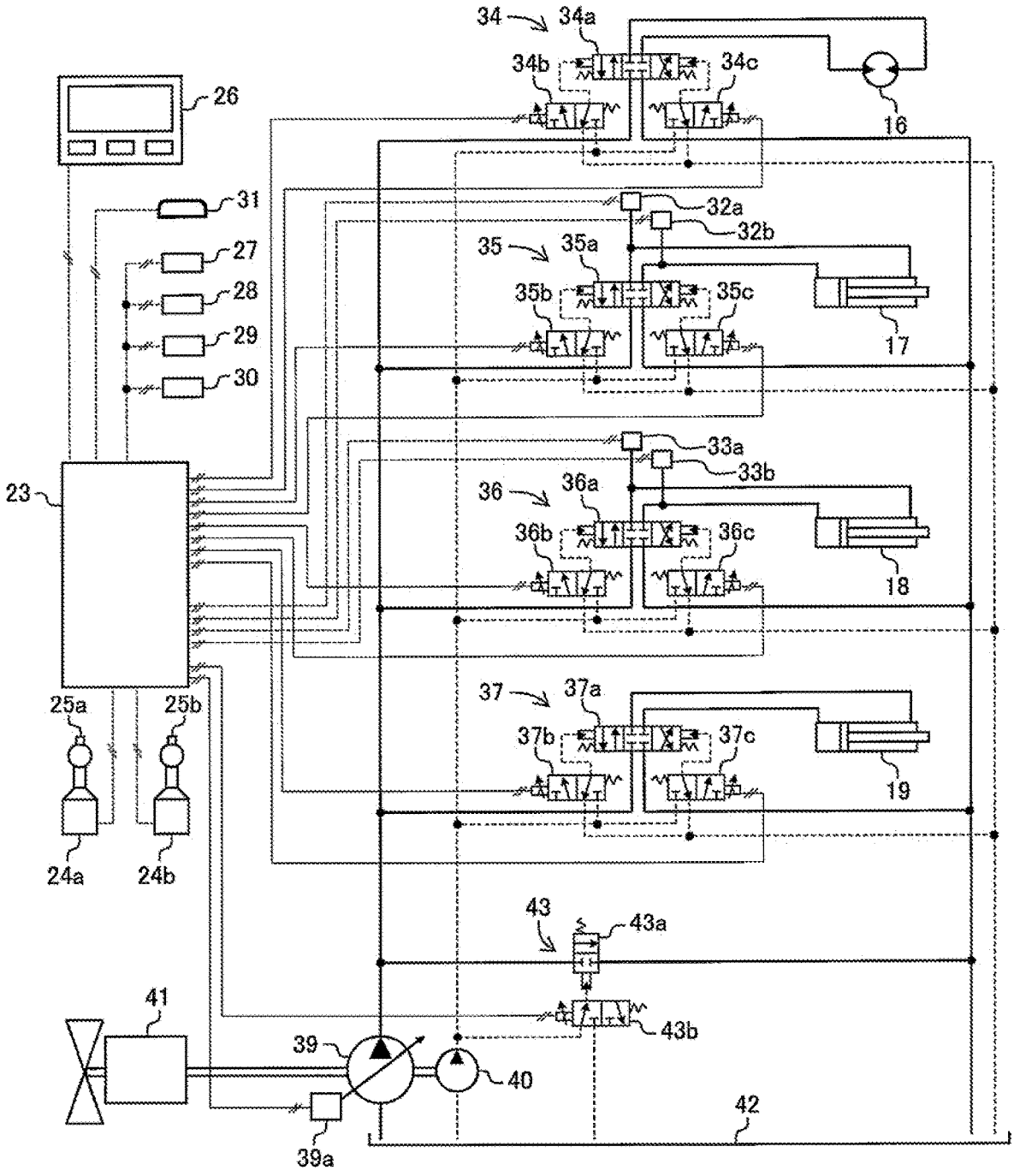
FIG. 2 is a diagram extracting and illustrating principal parts of a hydraulic circuit related to a driving mechanism of the hydraulic excavator.

FIG. 2 is a diagram extracting and illustrating principal parts of a hydraulic circuit related to a driving mechanism of the hydraulic excavator.

In FIG. 2, the driving mechanism of the hydraulic excavator 1 essentially includes a hydraulic pump 39, a pilot pump 40, control valves 34, 35, 36, and 37, a hydraulic operating fluid tank 42, and a bleed-off unit 43. The hydraulic pump 39 and the pilot pump 40 are driven by a prime mover 41 such as a diesel engine. The control valves 34, 35, 36, and 37 control the flow rates and directions of hydraulic fluids supplied from the hydraulic pump 39 to the hydraulic actuators 16, 17, 18, and 19. The hydraulic operating fluid tank 42 supplies hydraulic operating fluids to the hydraulic pump 39 and the pilot pump 40 and stores the hydraulic operating fluids discharged from the hydraulic actuators 16, 17, 18, and 19. The bleed-off unit 43 discharges some of the hydraulic fluids delivered from the hydraulic pump 39 to the hydraulic operating fluid tank 42.

The control valves 34, 35, 36, and 37 are driven by hydraulic pressures (pilot pressures) of the hydraulic fluids delivered from the pilot pump 40. The hydraulic fluids delivered from the pilot pump 40 are introduced into directional control valves 34*a*, 35*a*, 36*a*, and 37*a* via solenoid proportional pressure reducing valves 34*b* and 34*c*, 35*b* and 35*c*, 36*b* and 36*c*, and 37*b* and 37*c* of the control valves 34, 35, 36, and 37. The solenoid proportional pressure reducing valves 34*b* and 34*c*, 35*b* and 35*c*, 36*b* and 36*c*, and 37*b* and 37*c* are controlled on the basis of current commands output from the controller 23, so that the driving of the directional control valves 34*a*, 35*a*, 36*a*, and 37*a* is controlled. After the hydraulic fluids are supplied from the hydraulic pump 39 to the directional control valves 34*a*, 36*a*, and 37*a*, the flow rates of hydraulic fluids to be distributed to the hydraulic actuators 16, 17, 18, and 19 are adjusted according to operations of the solenoid proportional pressure reducing valves 34*b* and 34*c*, 35*b* and 36*b* and 36*c*, and 37*b* and 37*c*.

The hydraulic pump 39 is of a variable displacement type. When a regulator 39*a* operates on the basis of a current command output from the controller 23, the displacement of the hydraulic pump 39 is adjusted, and thus the flow rate of the hydraulic fluid to be delivered from the hydraulic pump 39 is controlled.

The bleed-off unit 43 includes a bleed-off valve 43*a* and a bleed-off valve solenoid proportional pressure reducing valve 43*b*. The bleed-off valve 43*a* allows some of the hydraulic fluids delivered from the hydraulic pump 39 to return to the hydraulic operating fluid tank 42. The bleed-off valve solenoid proportional pressure reducing valve 43*b* adjusts the flow rate of the hydraulic fluid to be released by the bleed-off valve 43*a*. Some of the hydraulic fluids delivered from the hydraulic pump 39 are discharged to the hydraulic operating fluid tank 42 when the bleed-off valve 43*a* makes a hydraulic line communicate with the hydraulic operating fluid tank 42. The bleed-off valve 43*a* is driven by a pilot pressure adjusted by the bleed-off valve solenoid proportional pressure reducing valve 43*b*. That is, the flow rate of the hydraulic fluid returning to the hydraulic operating fluid tank 42 via the bleed-off valve 43*a* is controlled by the pilot pressure adjusted by the bleed-off valve solenoid proportional pressure reducing valve 43*b* on the basis of a current command output from the controller 23.

The controller 23 is connected to the control lever 24, the operation button 25, the display input device 26, the inertial measuring devices 27, 28, 29, and 30, and the GNSS antenna 31. The controller 23 outputs current command signals for driving the solenoid proportional pressure reducing valves 34*b* and 34*c*, 35*b* and 35*c*, 36*b* and 36*c*, 37*b* and 37*c*, and 43*b* and the regulator 39*a* on the basis of respective input signals from the control lever 24, the operation button 25, the display input device 26, the inertial measuring devices 27, 28, 29, and 30, and the GNSS antenna 31, and drives the hydraulic actuators 16, 17, 18, and 19, the hydraulic pump 39, and the bleed-off unit 43. Thus, the controller 23 controls the operation of the hydraulic excavator 1.

Figure 3:
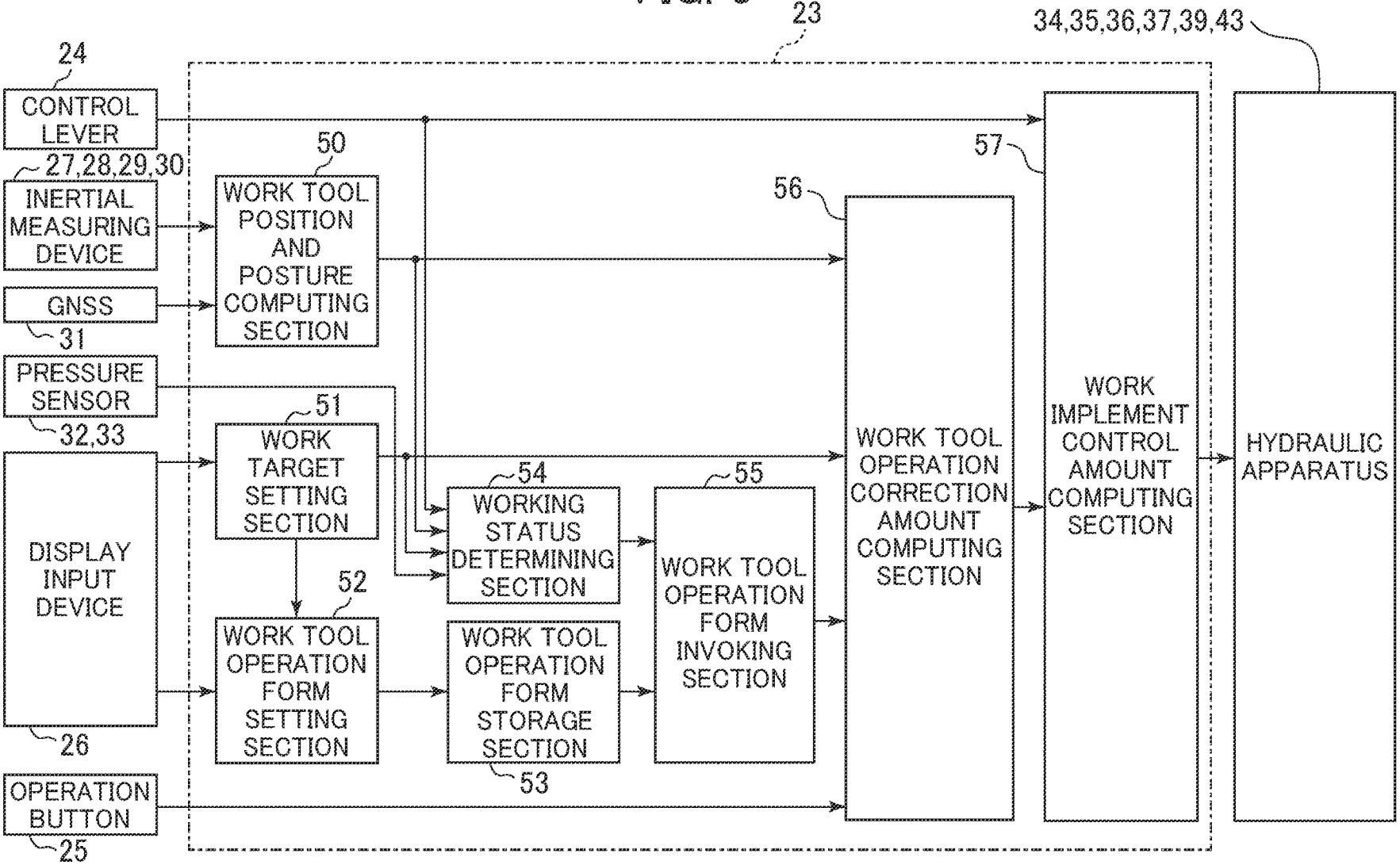
FIG. 3 is a functional block diagram illustrating functional sections of a controller according to an embodiment.

FIG. 3 is a functional block diagram illustrating functional sections of the controller according to the present embodiment.

In the present embodiment, a system within the controller 23 is executed as a combination of some programs. The controller 23 receives instruction signals from the control lever 24, the operation button 25, and the display input device 26 and sensing signals from the inertial measuring devices 27, 28, 29, and 30, a rotational angle meter 47, and the GNSS antenna 31 via interfaces, performs processing in the CPU, and then outputs, via interfaces, driving signals for individually driving the control valves 34, 35, 36, and 37, the hydraulic pump 39, and the bleed-off unit 43.

In FIG. 3, the controller 23 includes: a work tool position and posture computing section 50 that computes the position and posture of the front work implement 12 (for example, the claw tip position of the bucket 15 and the angle of the bucket 15 with respect to a horizontal plane) on the basis of sensing results from the inertial measuring devices 27, 28, 29, and 30 and the GNSS antenna 31; a work target setting section 51 that sets a work target (for example, a target surface or a work area) as information regarding the position and shape of a work target for the hydraulic excavator 1, on the basis of an instruction input by the operator to the display input device 26; a working status determining section 54 that determines a working status related to the present work of the hydraulic excavator 1, on the basis of an operation signal output from the control lever 24, sensing results from the pressure sensors 32 and 33, a computation result output from the work tool position and posture computing section 50, and the settings made by the work target setting section 51; a work tool operation form setting section 52 that sets a plurality of operation forms corresponding to operations of the bucket (work tool) in operation correction control (at a time of an assisting operation) on the basis of the instruction input by the operator to the display input device 26; a work tool operation form storage section 53 that stores the plurality of operation forms of the bucket 15 (work tool) which are set by the work tool operation form setting section 52; a work tool operation form invoking section 55 that invokes a work form from the plurality of operation forms stored in the work tool operation form storage section 53, on the basis of a determination result (that is, a determined working status) from the working status determining section 54; a work tool operation correction amount computing section 56 that computes an operation correction amount to make the bucket 15 (work tool) perform a predetermined operation, on the basis of the computation result from the work tool position and posture computing section 50, the work target set by the work target setting section 51, and the operation form decided by the work tool operation form invoking section 55; and a work implement control amount computing section 57 that computes control amounts of the respective hydraulic actuators 16, 17, 18, and 19 of the hydraulic excavator 1 on the basis of the settings made by the work target setting section 51, the operation signal (operation instruction from the operator) output from the control lever 24, the computation result from the work tool position and posture computing section 50, and the computation result (operation correction amount) from the work tool operation correction amount computing section 56, and outputs current commands (driving signals) to the control valves 34, 35, 36, and 37, the hydraulic pump 39 (regulator 39*a*), and the bleed-off unit 43.

Next, an example of the details of work performed by the hydraulic excavator according to the embodiment of the present invention under the operation correction control (assisting operation) and the like.

Figure 4:
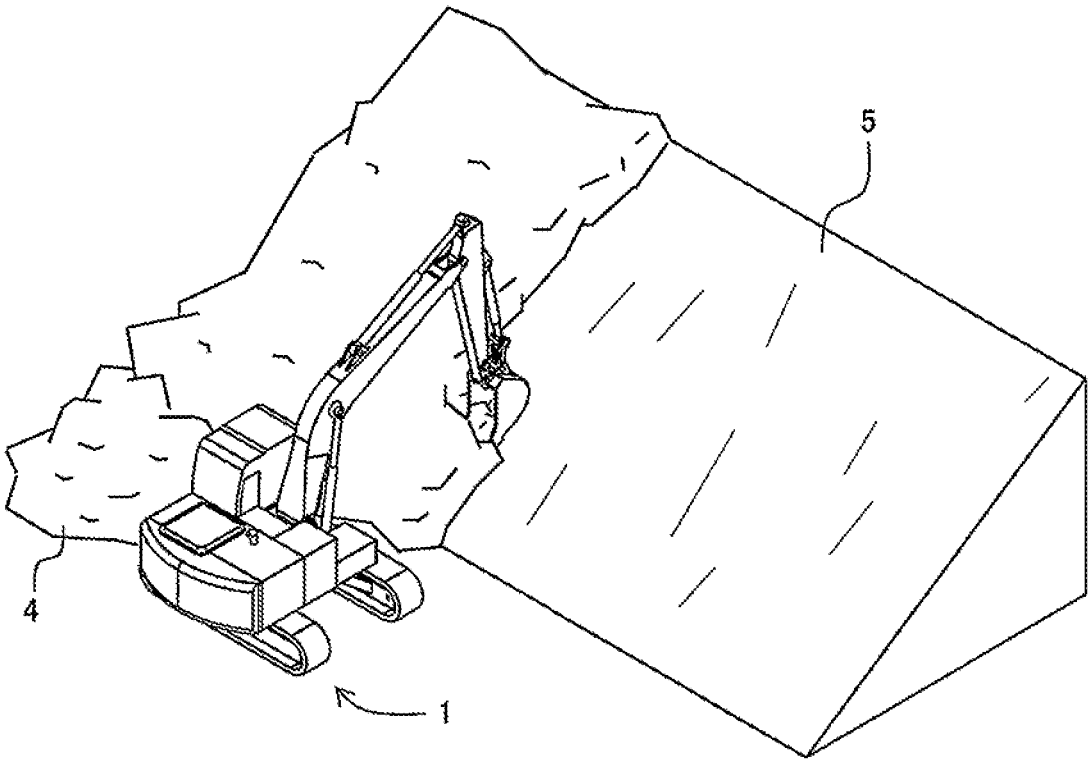
FIG. 4 is an overview diagram illustrating slope face shaping work as an example of work performed by the hydraulic excavator.
Figure 5:
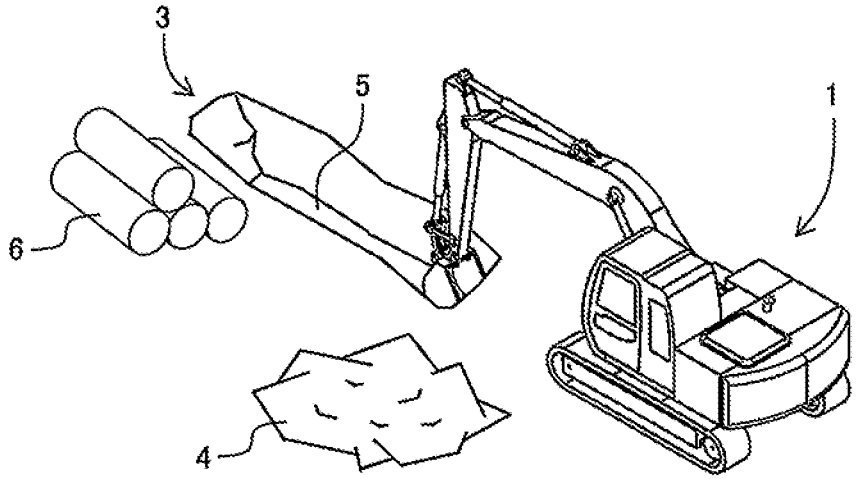
FIG. 5 is an overview diagram illustrating groove excavation work as an example of work performed by the hydraulic excavator.

FIG. 4 and FIG. 5 are overview diagrams illustrating examples of work performed by the hydraulic excavator. FIG. 4 is a diagram illustrating slope face shaping work. FIG. 5 is a diagram illustrating groove excavation work.

As illustrated in FIG. 4, in the slope face shaping work, the hydraulic excavator 1 shapes a target surface 5 into a flat surface by excavating soil. Specifically, the hydraulic excavator 1 excavates the soil with a claw tip of the bucket 15 made to coincide with the target surface 5, and after the soil is excavated to a certain extent, scoops the excavated soil by the bucket 15 and transports the excavated soil to a stock 4. The hydraulic excavator 1 repeats the excavating operation and the transporting operation. In addition, in order to make the target surface 5 resulting from the excavation flatter, the hydraulic excavator 1 scoops the soil in the stock 4 by the bucket 15, strews the soil over the whole of the target surface 5 by slightly dropping the soil from above the target surface 5, and then presses a bottom surface of the bucket 15 against the soil.

When such slope face shaping work is executed, the operation correction control (assisting operation) is performed to assist in the excavating operation on the target surface 5 such that the claw tip of the bucket 15 does not reach a position below the target surface 5, that is, the claw tip of the bucket 15 is moved along the target surface 5. In addition, in the operation of pressing the bucket 15 against the target surface 5, adjustment of the angle of the bucket 15 is assisted such that the bottom surface of the bucket 15 coincides with the target surface 5 while the claw tip of the bucket 15 is moved along the target surface 5. By performing the assisting operation in this way, accuracy of the slope face shaping work can be improved.

Moreover, in the operation of transporting the soil excavated by the target surface 5 to the stock 4 and the operation of transporting the soil scooped from the stock 4 to the target surface 5, the adjustment of the angle of the bucket 15 is assisted such that an opening plane where the bucket 15 is open is horizontal, so that the soil being transported can be prevented from dropping from the bucket Thus, extra work such as cleaning can be reduced, and work accuracy and work efficiency can be improved.

As illustrated in FIG. 5, in the groove excavation work (for example, work of burying a material 6), the hydraulic excavator 1 forms a groove 3 by excavating the ground, disposes the material 6 in the groove, and then refills the groove 3. Specifically, the hydraulic excavator 1 sets, to the target surface 5, a bottom surface of the groove 3 that has an appropriate height to dispose the material 6 therein, and excavates the ground with the claw tip of the bucket 15 of the hydraulic excavator 1 made to coincide with the target surface 5. After the ground is excavated to a certain extent, the hydraulic excavator 1 scoops the excavated soil by the bucket 15 and transports the excavated soil to the stock 4. The hydraulic excavator 1 repeats the excavating operation and the transporting operation. In addition, in order to refill the groove 3, the hydraulic excavator 1 repeats an operation of excavating and scooping the soil in the stock 4 by the bucket 15 and an operation of transporting the soil to above the groove 3 and dropping the soil.

When such groove excavation work is executed, the operation correction control (assisting operation) is performed to assist in the excavating operation on the target surface 5 such that the claw tip of the bucket 15 does not reach a position below the target surface 5, that is, the claw tip of the bucket 15 is moved along the target surface 5, so that the work accuracy can be improved.

Moreover, in the operation of transporting the soil excavated in forming the groove 3 to the stock 4 and the operation of transporting the soil scooped from the stock 4 to the groove 3, the adjustment of the angle of the bucket 15 is assisted such that the opening plane of the bucket 15 is horizontal, so that the soil being transported can be prevented from dropping from the bucket 15. Thus, extra work such as cleaning can be reduced, and the work accuracy and the work efficiency can be improved.

That is, as illustrated in FIG. 4 and FIG. 5, in order to improve the work accuracy and the work efficiency, the assisting operation for correcting the position and posture of the bucket 15 is preferably changed according to the working status such as the progress of the work.

Figure 6:
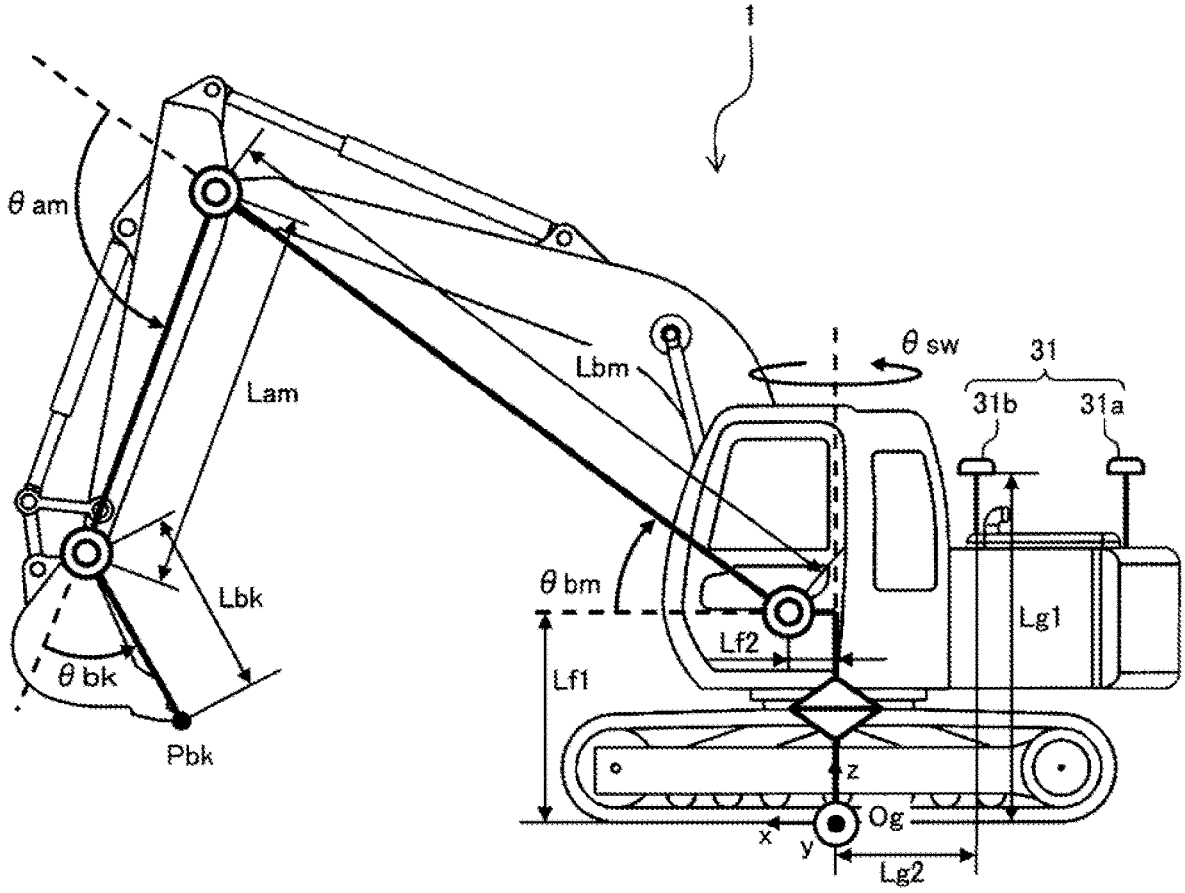
FIG. 6 is a diagram of assistance in explaining computation of the posture of the hydraulic excavator and schematically illustrates the whole of the hydraulic excavator in perspective.

FIG. 6 is a diagram of assistance in explaining computation of the posture of the hydraulic excavator and schematically illustrates the whole of the hydraulic excavator in perspective.

The work tool position and posture computing section 50 computes the distal end position (claw tip position) and posture (angle) of the bucket 15 as posture information regarding the hydraulic excavator 1 by using variables defined in FIG. 6. For the hydraulic excavator 1, a point of intersection of a swing axis of the upper swing structure 11 and a plane in contact with a lower side of the lower track structure 10 is defined as an origin Og of an excavator coordinate system. The position of the origin Og of the excavator coordinate system in a global coordinate system set outside the hydraulic excavator 1 can be obtained from the position of the GNSS antenna 31 in the global coordinate system which is sensed by the GNSS antenna 31, and from an attachment height Lg1 and a forward-rearward direction attachment length Lg2 of the GNSS antenna 31 with respect to the origin Og of the excavator coordinate system. In addition, the orientation of the excavator coordinate system with respect to the global coordinate system can be obtained by matching the orientation of the excavator coordinate system with the orientation (azimuth angle) of the hydraulic excavator 1 in the global coordinate system which is sensed by the GNSS antenna 31, about an axis perpendicular to the horizontal plane. Here, a simultaneous transformation matrix from the global coordinate system to the excavator coordinate system is defined as Tsh.

A distal end position (claw tip position) Pbk of the bucket 15 with respect to the origin Og of the excavator coordinate system can be obtained by using a swing angle θsw of the upper swing structure 11, a swing angle θbm of the boom 13, a swing angle θam of the arm 14, and a swing angle θbk of the bucket 15 as well as lengths Lf1, Lf2, Lbm, Lam, and Lbk of the respective members, and applying a D-H method (Denaviet-Hartenberg notation) or the like with the hydraulic excavator 1 as a link structure constituted of four links, that is, obtaining a product of simultaneous transformation matrices defined for the respective links.

Here, relations between the distal end position Pbk=(Xbk, Ybk, Zbk) of the bucket 15, an angle (Pitch_bk) formed between the horizontal plane (global coordinate system) and the excavator coordinate system, and the angles (θsw, θbm, θam, and θbk) between the respective members can be expressed by the following vector equations (Equation 1) to (Equation 3). Incidentally, "^T" in (Equation 1) and (Equation 2) below represents transposition.

$$r=[Xbk, Ybk, Zbk, \text{Pitch_}bk]\hat{}T \quad \text{(Equation 1)}$$

$$q=[\theta sw, \theta bm, \theta am, \theta bk]\hat{}T \quad \text{(Equation 2)}$$

$$r=F(q) \quad \text{(Equation 3)}$$

Figure 7:
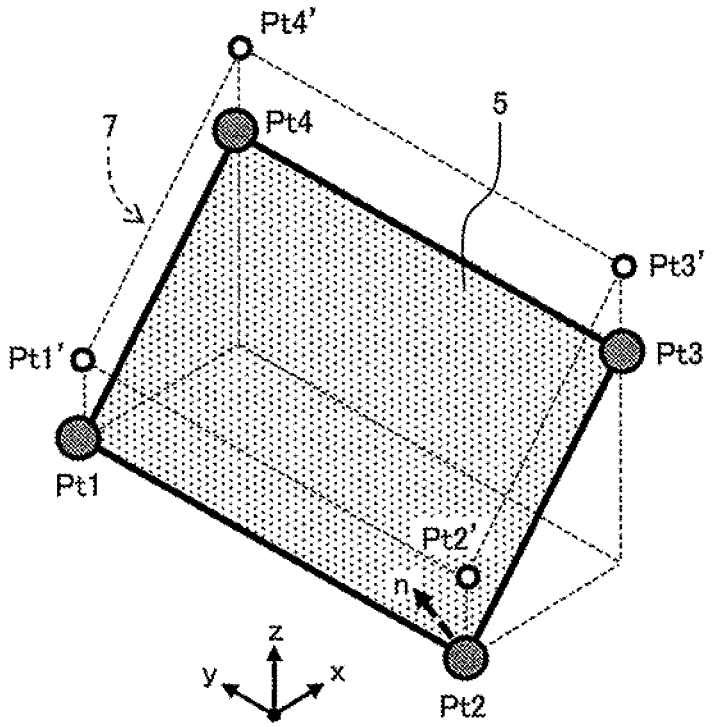
FIG. 7 is a diagram illustrating work targets in the slope face shaping work as an example of work targets.
Figure 8:
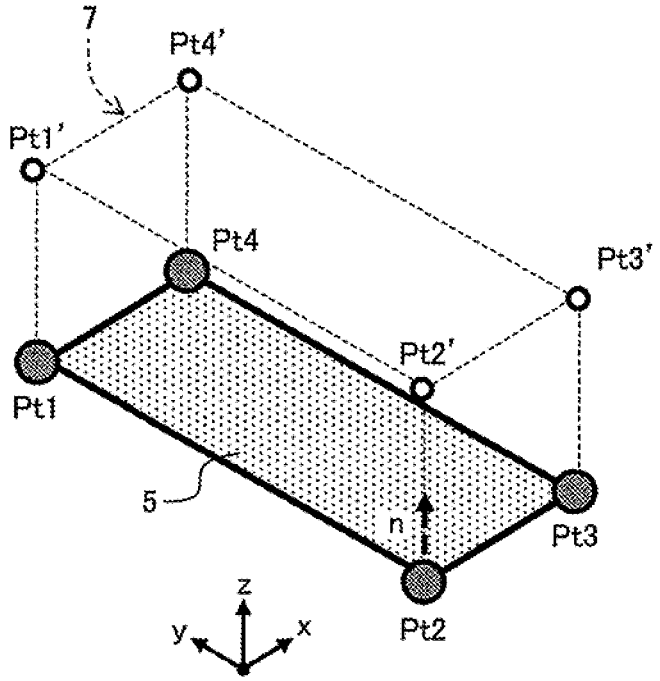
FIG. 8 is a diagram illustrating work targets in the groove excavation work as an example of the work targets.

FIG. 7 and FIG. 8 are diagrams illustrating an example of work targets. FIG. 7 is a diagram illustrating the work targets in the slope face shaping work. FIG. 8 is a diagram illustrating the work targets in the groove excavation work. Incidentally, in FIG. 7 and FIG. 8, the target surface 5 and a work area 7 are illustrated as the work targets, which are pieces of information regarding the position and shape of the work targets.

As illustrated in FIG. 7 and FIG. 8, in the work target setting section 51, the target surface 5, which is one of the work targets in the slope face shaping work (see FIG. 4) and the groove excavation work (see FIG. 5), is defined as a rectangular plane formed with four representative points Pt1 to Pt4 as vertices thereof. A vector n=[nx, ny, nz]^T normal to the target surface 5 can be obtained by normalizing an outer product of a vector (Pt3−Pt2) and a vector (Pt1−Pt2). In addition, supposing that representative points Pt1' to Pt4' different from the representative points Pt1 to Pt4 defining the target surface 5 are set above the target surface 5, the work area 7, which is one of the work targets, is defined as a solid in a three-dimensional space which has the target surface 5 as one of surfaces thereof. That is, the work target setting section 51 sets the target surface 5 as a work target on the basis of an instruction (representative points Pt1 to Pt4) input by the operator to the display input device 26, and sets the work area 7 as a work target on the basis of the instruction (representative points Pt1 to Pt4 and Pt1' to Pt4').

Figure 9:
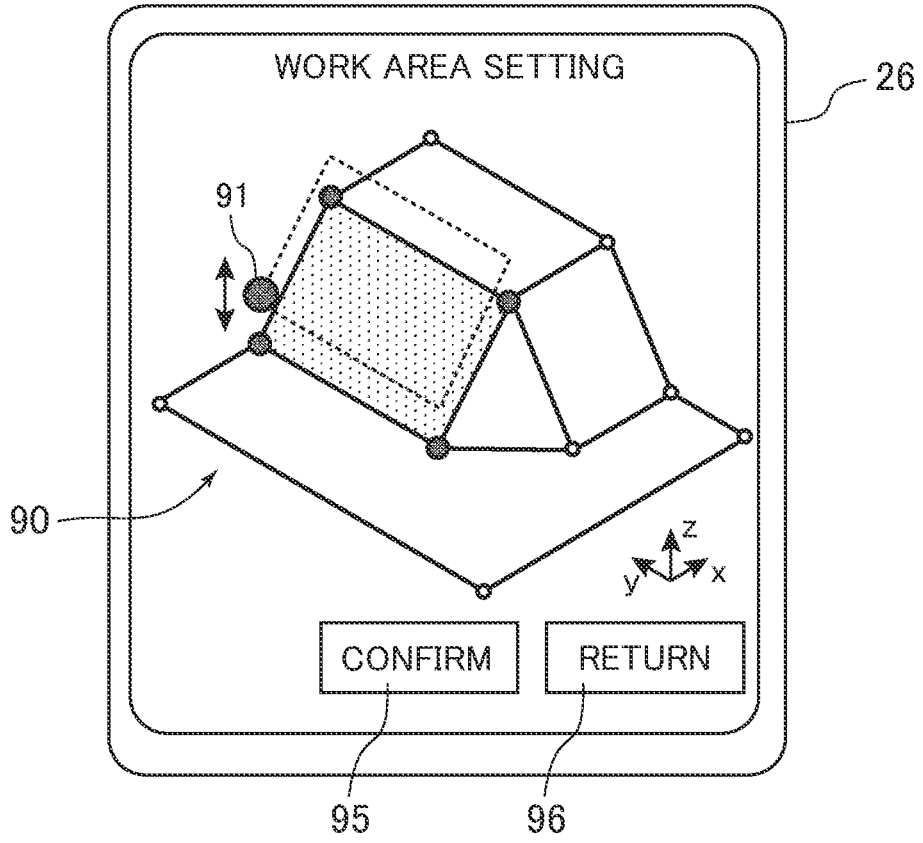
FIG. 9 is a diagram illustrating a work area setting screen as an example of an input screen displayed on a display input device.
Figure 10:
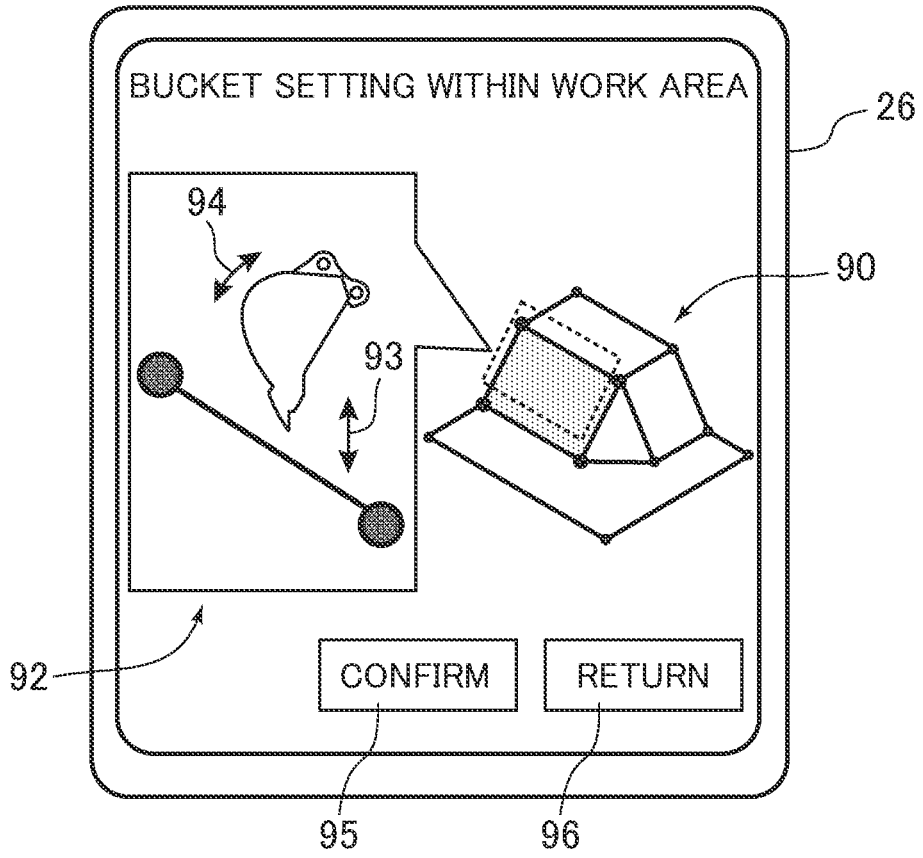
FIG. 10 is a diagram illustrating a manner in which an intra-work area bucket setting screen is displayed, as an example of the input screen displayed on the display input device.

FIG. 9 and FIG. 10 are diagrams illustrating an example of an input screen displayed on the display input device. FIG. 9 is a diagram illustrating a manner in which a work area setting screen is displayed. FIG. 10 is a diagram illustrating a manner in which an intra-work area bucket setting screen is displayed.

As illustrated in FIG. 9, on the display input device 26, a GUI displays a work target display 90, which is the whole image of the work target, from information of a construction drawing set on the input screen (work area setting screen) in advance, and displays a selection status of any surface on the work target display 90 which is to be set as the target surface 5. In addition, the GUI displays a confirmation button 95 and a return button 96 on the screen and receives a selection input by the operator of the hydraulic excavator 1. When the confirmation button 95 is depressed in a state in which any surface is selected, the target surface 5 is set as a target to which the work area 7 is set. When the target surface 5 is set by depressing the confirmation button 95, a work area adjustment display 91 for setting the work area 7 is displayed, and a setting of the size of the work area 7, that is, a distance from the target surface 5 to the upper surface of the work area 7 (surface defined by representative points Pt1' to Pt4' in FIG. 7 and FIG. 8), made by the operator of the hydraulic excavator 1 is received.

In the present embodiment, a case where the target surface 5 and the upper surface of the work area 7 are defined to be parallel with each other and where the size of the work area 7 is set by indicating one of the four representative points constituting the upper surface on the work area adjustment display 91 has been described by way of example. It is to be noted, however, that the configuration is not limited to this. For example, such a configuration may be adopted that distances from the target surface 5 to a plurality of points among the four representative points constituting the upper surface of the work area 7 can be adjusted individually.

In addition, when the size of the work area 7 is set by depressing of the confirmation button 95 on the work area setting screen of the display input device 26, an intra-work area bucket setting screen 92 is next displayed on the display input device 26. On the intra-work area bucket setting screen 92, the details of the assisting operation (operation form) for the bucket 15 within the work area 7 is set. The intra-work area bucket setting screen 92 displays a bucket height adjustment display 93 and receives a setting of the claw tip position of the bucket 15 (distance from the target surface 5) made by the operator. The intra-work area bucket setting screen 92 also displays a bucket posture adjustment display 94 and receive a setting of the posture (angle with respect to the horizontal plane) of the bucket 15 made by the operator. Incidentally, on the intra-work area bucket setting screen 92, the claw tip position and posture of the bucket 15 are set to correspond to each of a plurality of kinds of operation forms.

The kinds of operation forms of the assisting operation include a "bucket posture maintaining mode," a "claw tip position designating mode," and a "bucket horizontal maintaining mode." The "bucket posture maintaining mode" is an operation form in which the angle of the bucket 15 is controlled such that the bottom surface of the bucket 15 is made to coincide with the target surface 5. In addition, the "claw tip position designating mode" is an operation form in which the position of the bucket 15 is controlled such that the claw tip of the bucket 15 is made to coincide with the target surface 5. Moreover, the "bucket horizontal maintaining mode" is an operation form in which the angle of the bucket 15 is controlled such that the opening plane of the bucket 15 is held horizontal.

The work tool operation form setting section 52 sets an operation form on the basis of the instruction input by the operator to the display input device 26, and stores the operation form in the work tool operation form storage section 53.

Next, working status determination processing in the working status determining section 54 will be described. The working status determining section 54 performs work type determination processing and work tool state determination processing as the working status determination processing for determining a working status indicating the status of the work of the hydraulic excavator 1. In the work type determination processing, a work type that is a classification indicating the state of the work being performed by the hydraulic excavator 1 is determined on the basis of the computation result from the work tool position and posture computing section 50 and the settings made by the work target setting section 51. In addition, in the work tool state determination processing, a work tool state that is the state of the bucket 15 is determined on the basis of the sensing results from the pressure sensors 32 and 33 and the computation result from the work tool position and posture computing section 50. Incidentally, the working status determination processing (the work type determination processing and the work tool state determination processing) in the controller 23 is repeatedly performed at intervals of a unit processing time (for example, a sampling time) determined in advance.

In the work type determination processing, the work type, which is the classification indicating the state of the work being performed by the hydraulic excavator 1, is set on the basis of the position and operation direction of the front work implement 12 (specifically, the bucket 15).

Figure 11:
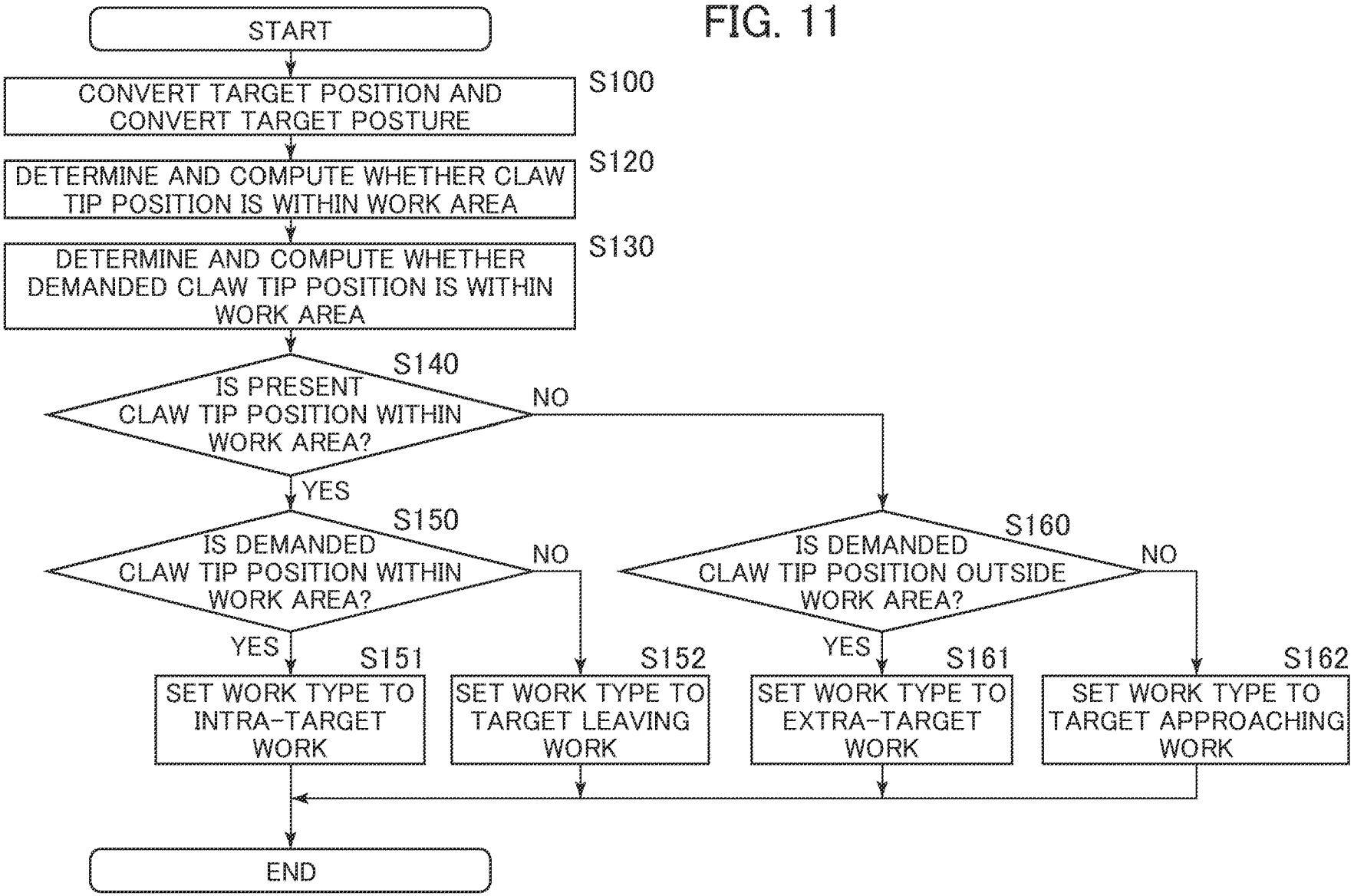
FIG. 11 is a flowchart illustrating the details of work type determination processing.

FIG. 11 is a flowchart illustrating the details of the work type determination processing.

As illustrated in FIG. 11, in the work type determination processing, the controller 23 first transforms the representative points Pt1 to Pt4 and Pt1' to Pt4' (see FIG. 7 and FIG. 8) of the work area 7 that are set by the work target setting section 51 and the normal vector n, the representative points and the normal vector being expressed in the global coordinate system, from the global coordinate system to the coordinate system of the hydraulic excavator 1 (machine body coordinate system) (step S100).

The transformation of the representative points Pt1 to Pt4 and Pt1' to Pt4' and the normal vector n from the global coordinate system to the machine body coordinate system can be performed according to (Equation 4) to (Equation 6) below using a simultaneous transformation matrix Tsh (here, suppose that "l" is a positive integer indicating a number).

$$Ptl=(Tsh\hat{}-1)\times Pt \quad \text{(Equation 4)}$$

$$Ptl'=(Tsh\hat{}-1)\times Pt' \quad \text{(Equation 5)}$$

$$nl=(Tsh\hat{}-1)\times(Pt+n)-Ptl \quad \text{(Equation 6)}$$

Next, whether or not a claw tip position Pst of the bucket 15 is within the work area 7 is determined on the basis of the computation result from the work tool position and posture computing section 50 and the settings made by the work target setting section 51 (step S120).

Figure 12:
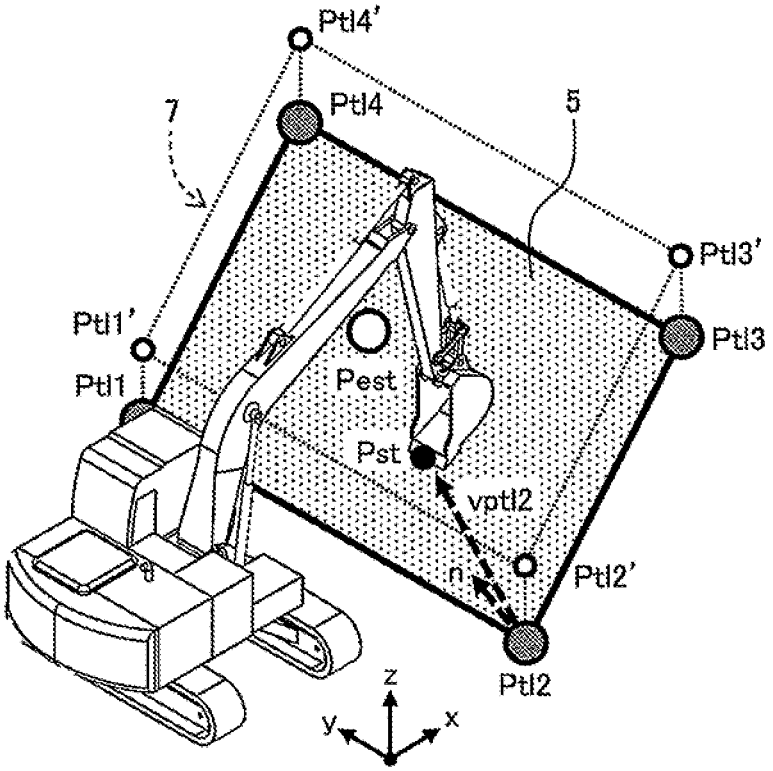
FIG. 12 is a diagram of assistance in explaining a method of determining whether or not a claw tip position of a bucket is present within a work area.

Whether or not the claw tip position Pst of the bucket 15 is within the work area 7 can be determined, for example, by using the magnitude of an inner product of a normal to each surface of a hexahedron formed by the representative points Pt1 to Pt4 and Pt1' to Pt4', the normal extending in a direction towards the area, and a vector connecting each representative point and the claw tip position Pst of the bucket 15 to each other. For example, as illustrated in FIG. 12, when an inner product of a vector nl normal to the target surface 5 and a vector vpt12 connecting the representative point Pt2 and the claw tip position Pst of the bucket 15 to each other is equal to or more than 0 (zero), it can be determined that the claw tip position Pst is located on the upper side of the target surface 5, that is, the work area 7 side. When the inner product is less than 0 (zero), it can be determined that the claw tip position Pst is located on the lower side of the target surface 5, that is, outside the work area 7. Similar processing is performed for all of the surfaces constituting the work area 7. When all of the inner products are equal to or more than 0 (zero), it can be determined that the claw tip position Pst of the bucket 15 is located within the work area 7.

Next, a movement destination of the claw tip position Pst of the bucket 15 corresponding to an operation made by the operator of the hydraulic excavator 1, that is, a demanded claw tip position Pest demanded by the operator, is predicted on the basis of an operation signal output from the control lever 24, and whether a result of the prediction (demanded claw tip position Pest) is within the work area 7 is determined (step S130).

The demanded claw tip position Pest can be obtained by (Equation 7) and (Equation 8) below. In the following Equations, ωlev represents angular velocity target values of the angles θsw, θbm, θam, and θbk of the respective parts which are obtained by geometric transformation of speed target values of the swing hydraulic motor 16, the boom cylinder 17, the arm cylinder 18, and the bucket cylinder 19, the speed target values being proportional to operation amounts (operation signals) of the control lever 24, and an estimated time Δtest determined in advance is used.

$$J(q)=\partial F(q)/\partial q \quad \text{(Equation 7)}$$

$$Pest=Pst+J(q)\times\omega lev\times\Delta test \quad \text{(Equation 8)}$$

Whether or not the demanded claw tip position Pest is located within the work area 7 can be determined by subjecting the obtained demanded claw tip position Pest to computation similar to that of step S120.

Next, whether the present claw tip position Pst of the bucket 15 is within the work area 7 is determined on the basis of a result of the computation in step S120 (step S140).

When a result of the determination is YES, whether the demanded claw tip position Pest is within the work area 7 is next determined on the basis of a result of the computation in step S130 (step S150).

When a result of the determination in step S150 is YES, that is, when both the claw tip position Pst and the demanded claw tip position Pest of the bucket 15 are within the work area 7, the work type indicating the state of the work of the hydraulic excavator 1 is set to "intra-target work" which indicates that the work is being performed within the work area 7 (step S151). The processing is then ended.

In contrast, when the result of the determination in step S150 is NO, that is, when the present claw tip position Pst of the bucket 15 is within the work area 7 but the demanded claw tip position Pest is outside the work area 7, the work type is set to "target leaving work" which indicates that the position of the bucket 15 is moving from the inside of the work area 7 towards the outside of the work area 7 (step S152). The processing is then ended.

In addition, when a result of the determination in step S140 is NO, that is, when the present claw tip position Pst of the bucket 15 is outside the work area 7, whether or not the demanded claw tip position Pest is outside the work area 7 is next determined on the basis of the result of the computation in step S130 (step S160).

When a result of the determination in step S160 is YES, that is, when both the present claw tip position Pst and the demanded claw tip position Pest of the bucket 15 are outside the work area 7, the work type indicating the state of the work of the hydraulic excavator 1 is set to "extra-target work" which indicates that work is being performed outside the work area 7 (step S161). The processing is then ended.

In contrast, when the result of the determination in step S160 is NO, that is, when the present claw tip position Pst of the bucket 15 is outside the work area 7 but the demanded claw tip position Pest is within the work area 7, the work type is set to "target approaching work" which indicates that the position of the bucket 15 is approaching the target surface 5 within the work area 7 from the outside of the work area 7 (step S162). The processing is then ended.

In the work tool state determination processing, the work tool state, which is the classification indicating the state of the bucket 15 (work tool), is set on the basis of the posture (angle) of the bucket 15 with respect to the target surface 5 and a load on the front work implement 12.

Figure 13:
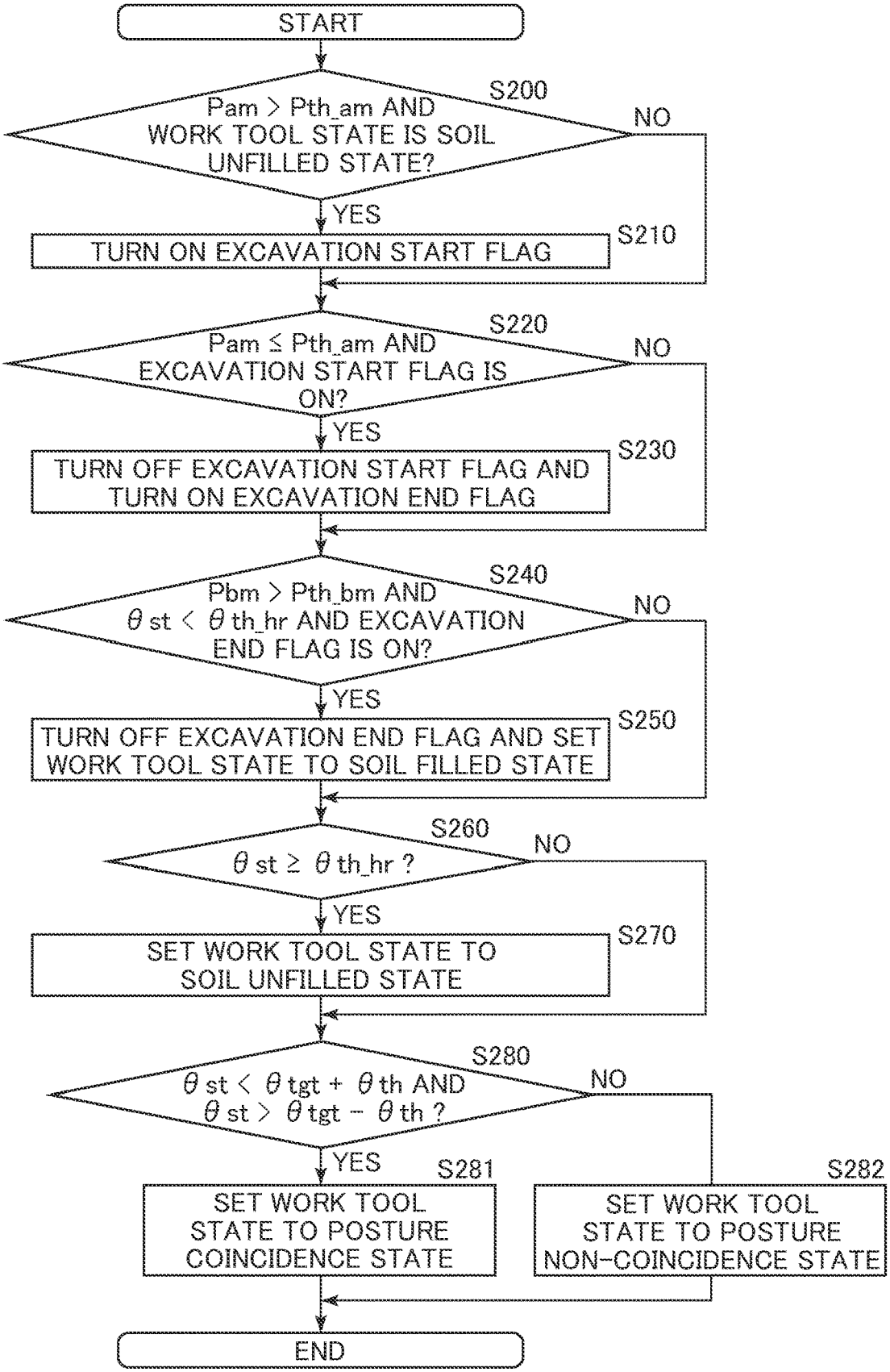
FIG. 13 is a flowchart illustrating the details of work tool state determination processing.

FIG. 13 is a flowchart illustrating the details of the work tool state determination processing.

Incidentally, in the work tool state determination processing, the work tool state includes both a filling state of the bucket 15 (determination result indicating whether or not the bucket 15 is filled with soil) and a coincidence state of the bucket 15 (determination result indicating whether or not the bottom surface of the bucket is close to a state of coinciding with the target surface Each of the states is stored independently.

Incidentally, as the work tool state, a work tool state at a time of a previous processing cycle is taken over and stored. Here, it is assumed that, as initial values, the filling state is a "soil unfilled state" and the coincidence state is a "posture coincidence state," for example.

As illustrated in FIG. 13, in the work tool state determination processing, the controller 23 first determines whether or not a bottom pressure Pam of the arm cylinder 18 is lower than a threshold value Pth_am determined in advance and the work tool state (filling state) is the "soil unfilled state" which indicates a state in which no soil is present within the bucket 15, on the basis of the sensing result from the pressure sensor 33 and the stored contents of the work tool state (filling state) (step S200).

When a result of the determination in step S200 is YES, that is, when the bottom pressure Pam of the arm cylinder 18 is higher than the threshold value Pth_am and the work tool state (filling state) is the "soil unfilled state," an excavation start flag indicating that the excavating operation is started is set to "ON" (step S210).

Figure 14:
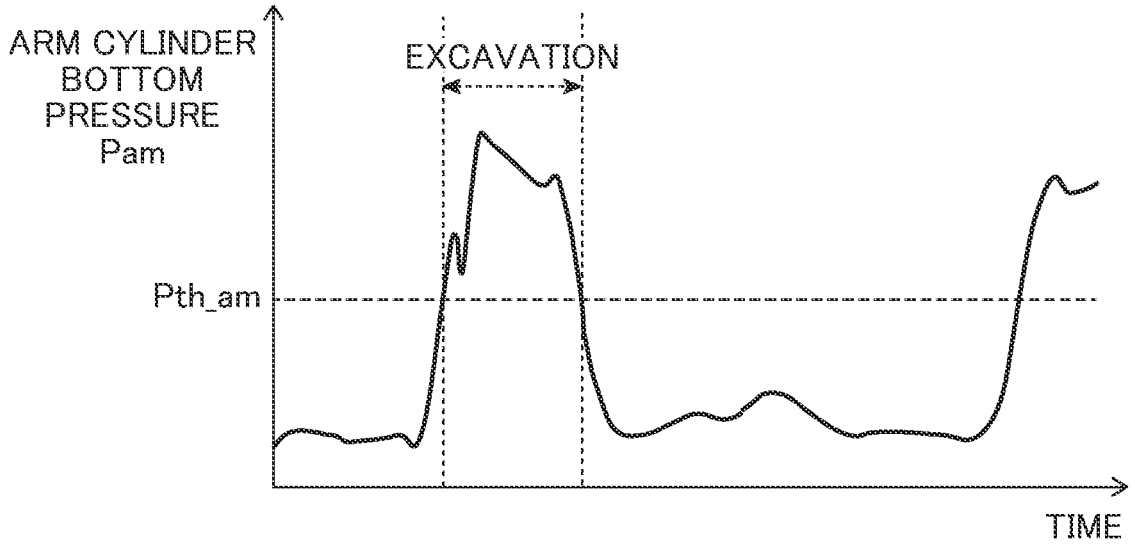
FIG. 14 is a diagram illustrating a result of sensing of a bottom pressure of an arm cylinder as an example of a sensing result from a pressure sensor.

FIG. 14 is a diagram illustrating a result of sensing of the bottom pressure of the arm cylinder as an example of the sensing result from the pressure sensor.

In the excavating operation by the hydraulic excavator 1, the arm 14 is driven in a crowding direction, that is, the arm cylinder 18 is extended. Hence, as illustrated in FIG. 14, the bottom pressure Pam of the arm cylinder 18 is high during excavation. Therefore, it can be determined that the excavating operation is started, when the bottom pressure Pam of the arm cylinder 18 becomes equal to or higher than an excavation start threshold value (Pth_am). That is, whether or not the excavating operation is started can be determined on the basis of the determination in step S200.

Next, when the result of the determination in step S200 is NO or when the processing of step S210 is ended, whether or not the bottom pressure Pam of the arm cylinder 18 is equal to or lower than the threshold value Pth_am determined in advance and the excavation start flag is "ON" is next determined on the basis of the sensing result from the pressure sensor 33 and the stored contents of the work tool state (filling state) (step S220).

When a result of the determination in step S220 is YES, that is, when the bottom pressure Pam of the arm cylinder 18 is equal to or lower than the threshold value Pth_am and the excavation start flag is "ON," the excavation start flag is set to "OFF," and an excavation end flag indicating that the excavating operation is ended is set to "ON" (step S230).

When the excavating operation by the hydraulic excavator 1 is ended, the bottom pressure Pam of the arm cylinder 18 becomes low, as illustrated in FIG. 14. Thus, it can be determined that the excavating operation is ended, when the bottom pressure Pam of the arm cylinder 18 becomes equal to or lower than the excavation start threshold value (Pth_am) after the excavating operation is started, that is, in a state in which the excavation start flag is "ON." That is, whether or not the excavating operation is ended can be determined on the basis of the determination in step S220.

Next, when the result of the determination in step S220 is NO or when the processing of step S230 is ended, whether or not a bottom pressure Pbm of the boom cylinder 17 is higher than a threshold value Pth_bm determined in advance and an angle θst of the bottom surface of the bucket 15 with respect to the horizontal plane is smaller than a threshold value θth_hr determined in advance and the excavation end flag is "ON" is then determined on the basis of the sensing result from the pressure sensor 32, the contents of the excavation end flag, and the computation result from the work tool position and posture computing section 50 (step S240). Incidentally, the angle θst can be computed as a sum of the angles θbm, θam, and θbk and an angle formed between the opening plane and the bottom surface of the bucket 15.

When a result of the determination in step S240 is YES, that is, when the bottom pressure Pbm of the boom cylinder 17 is higher than the threshold value Pth_bm and the angle θst is smaller than the threshold value th_hr and the excavation end flag is "ON," the excavation end flag is set to "OFF," and the work tool state (filling state) is set to a "soil filled state" which indicates that the bucket 15 is filled with soil (step S250).

Figure 15:
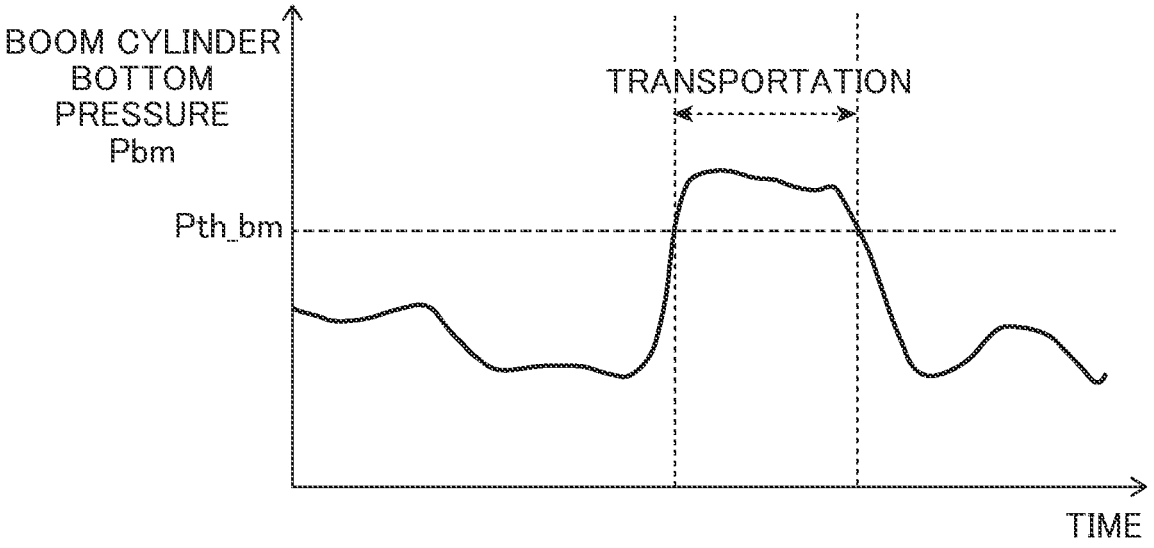
FIG. 15 is a diagram illustrating a result of sensing of a bottom pressure of a boom cylinder as an example of a result from the pressure sensor.
Figure 16:
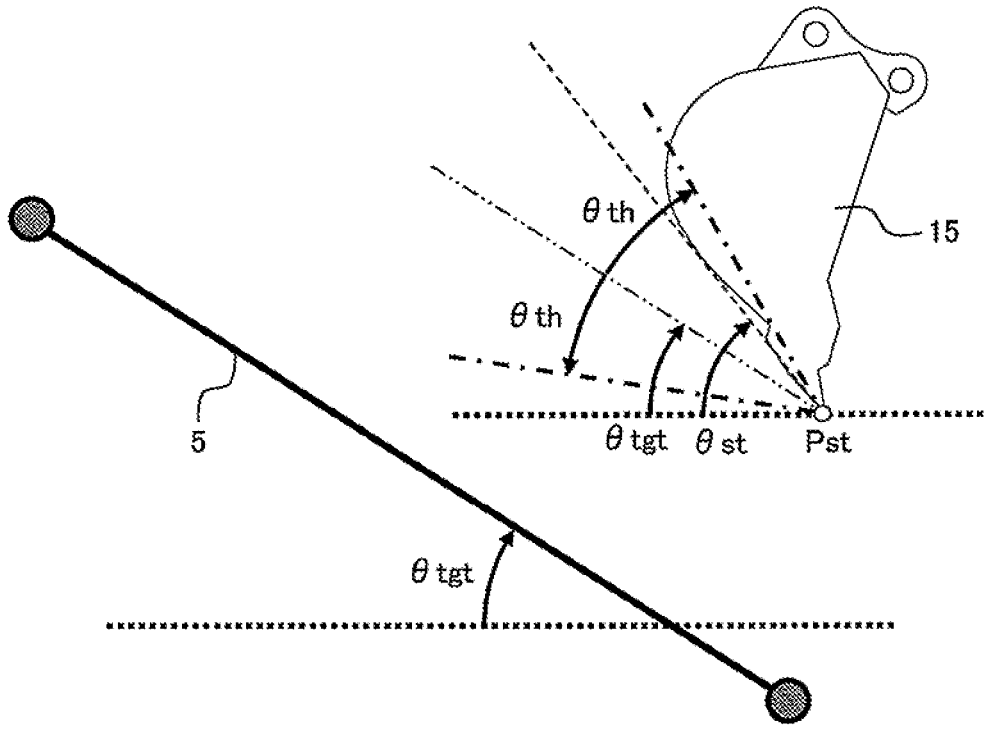
FIG. 16 is a diagram of assistance in explaining the posture of the bucket.
Figure 17:
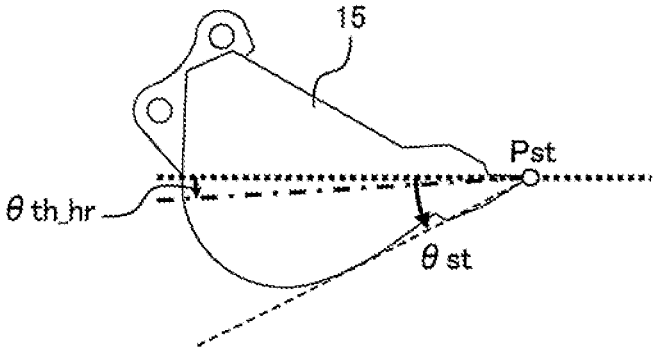
FIG. 17 is a diagram of assistance in explaining the posture of the bucket.

FIG. 15 is a diagram illustrating a result of sensing of the bottom pressure of the boom cylinder as an example of the sensing result from the pressure sensor. In addition, FIG. 16 and FIG. 17 are diagrams of assistance in explaining the posture of the bucket.

In the transporting operation performed by the hydraulic excavator 1 after the excavating operation, the bucket 15 is filled with soil, and therefore, the weight of the bucket 15 is increased. Thus, as illustrated in FIG. 15, it can be determined that the bucket 15 is in a state of being filled with soil, when the bottom pressure Pbm of the boom cylinder 17 supporting the weight of the whole of the front work implement 12 including the bucket 15 is increased and the bottom pressure Pbm of the boom cylinder 17 becomes equal to or more than a soil filling determination threshold value (Pt_bm). In addition, in the soil transporting operation, as illustrated in FIG. 17, the opening plane of the bucket 15 needs to be close to the horizontal. That is, it can be determined that the soil transporting operation is started, when the bottom pressure Pbm of the boom cylinder 17 is high, when the opening plane of the bucket 15 is close to the horizontal, and when the excavating operation is ended (the excavation end flag is "ON"). That is, whether or not the transporting operation is started can be determined on the basis of the determination in step S240.

Next, when the result of the determination in step S240 is NO or when the processing of step S250 is ended, whether or not the angle θst of the bottom surface of the bucket 15 with respect to the horizontal plane is equal to or higher than the threshold value θth_hr determined in advance is then determined on the basis of the computation result from the work tool position and posture computing section 50 (step S260).

When a result of the determination in step S260 is YES, that is, when the opening plane of the bucket 15 is not horizontal, the work tool state (filling state) is set to the "soil unfilled state," which indicates that the bucket 15 is not filled with soil (step S270).

As illustrated in FIG. 17, when the opening plane of the bucket 15 is not horizontal, the contents of the bucket drop therefrom, and therefore, it can be determined that no soil is present within the bucket 15. That is, whether or not the bucket 15 contains no soil can be determined on the basis of the determination in step S260.

Next, when the result of the determination in step S260 is NO or when the processing of step S270 is ended, whether or not the angle θst of the bottom surface of the bucket 15 with respect to the horizontal plane is smaller than a sum of an angle θtgt formed between the target surface 5 and the horizontal plane and a threshold value θth determined in advance and the angle θst is larger than a difference (θtgt−θth) between the angle θtgt and the threshold value θth is then determined (step S280).

When a result of the determination in step S280 is YES, the work tool state (coincidence state) is set to the "posture coincidence state" which indicates that the orientations of the bottom surface of the bucket 15 and the target surface 5 substantially coincide with each other (step S281). The processing is then ended. In contrast, when the result of the determination in step S280 is NO, the work tool state (coincidence state) is set to a "posture non-coincidence state" which indicates that the angle of the bottom surface of the bucket 15 and the angle of the target surface 5 do not coincide with each other (step S282). The processing is then ended.

As illustrated in FIG. 16, when the angle θst of the bottom surface of the bucket 15 with respect to the horizontal plane falls within the range of the threshold value θth set in advance with respect to the angle θtgt formed between the target surface 5 and the horizontal plane, it can be determined that the orientations of the bottom surface of the bucket 15 and the target surface 5 substantially coincide with each other. That is, whether or not the orientations of the bottom surface of the bucket 15 and the target surface 5 coincide with each other can be determined on the basis of the determination in step S280.

Next, operation form invocation processing in the work tool operation form invoking section 55 will be described. The work tool operation form invoking section 55 performs operation form readout processing for reading an operation form stored in the work tool operation form storage section 53, on the basis of a processing result of the working status determination processing (the work type determination processing and the work tool state determination processing) in the working status determining section 54. Incidentally, the operation form readout processing in the controller 23 is repeatedly performed at intervals of a unit processing time (for example, a sampling time) determined in advance.

Figure 18:
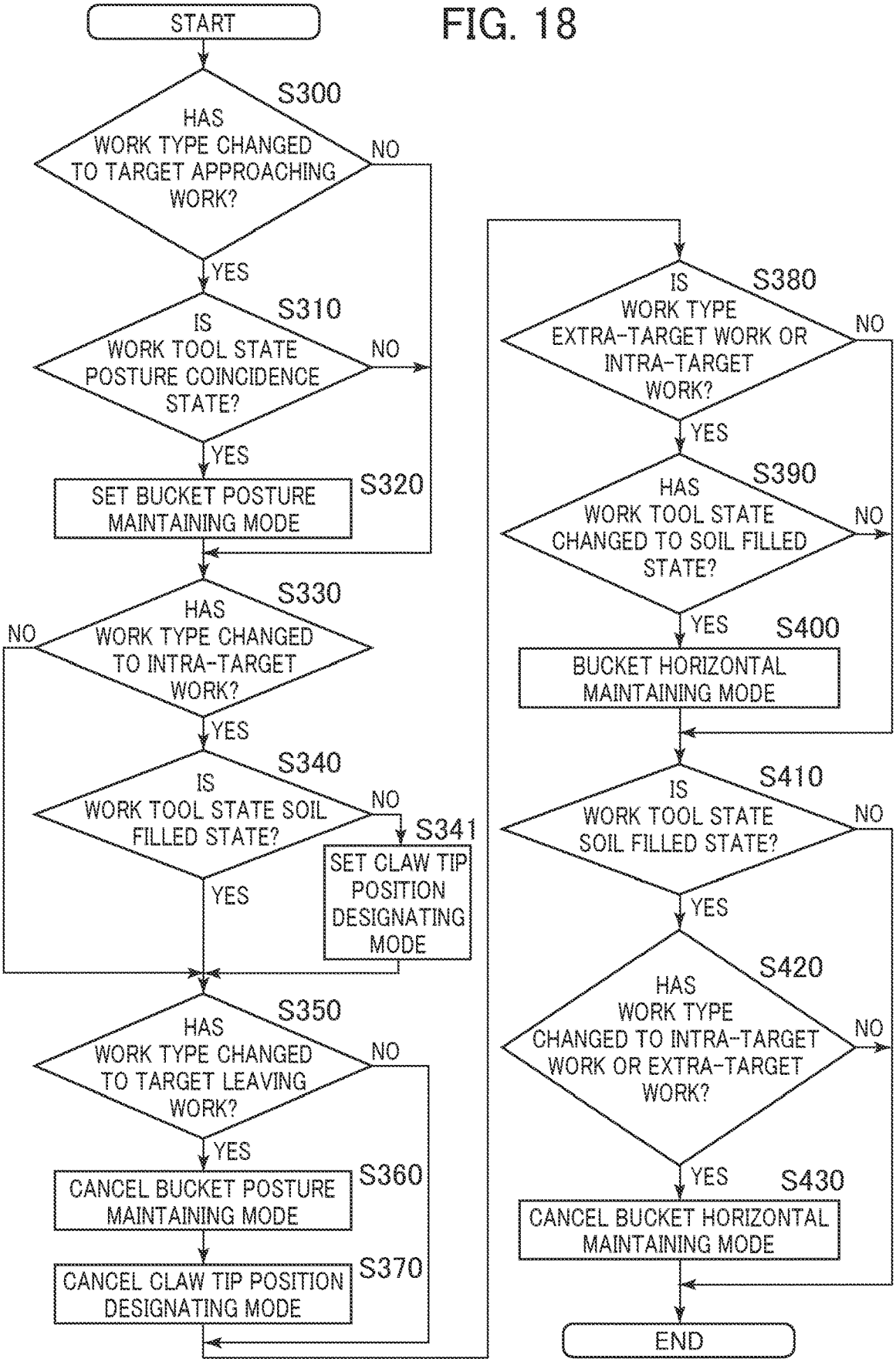
FIG. 18 is a flowchart illustrating the details of operation form readout processing.

FIG. 18 is a flowchart illustrating the details of the operation form readout processing.

As illustrated in FIG. 18, in the operation form readout processing, the controller 23 first determines whether or not the work type determined by the work type determination processing in the working status determining section 54 has changed from the extra-target work to the target approaching work (step S300). In addition, when a result of the determination in step S300 is YES, whether or not the work type determined by the work type determination processing in the working status determining section 54 is the posture coincidence state is then determined (step 310).

When a result of the determination in step S310 is YES, that is, when the work type has changed to the target approaching work and the work tool state is the posture coincidence state, the "bucket posture maintaining mode" is read out from the work tool operation form storage section 53 and set as an operation form (step S320).

A state in which the work type has changed from the extra-target work to the target approaching state can be considered to be a state in which the bucket 15 is to enter the work area 7, and can thus be determined to be a working status in which the operator of the hydraulic excavator 1 intends to make a transition to the work in the vicinity of the target. In addition, at this time, when the work tool state is the posture coincidence state, it can be determined that it is a working status in which the bottom surface of the bucket 15 is to coincide with the target surface 5. That is, it is possible to determine, on the basis of the determinations in steps S300 and S310, whether or not an assisting operation appropriate for the present working status is the "bucket posture maintaining mode," which is the operation form in which the angle of the bucket 15 is controlled to make the bottom surface of the bucket 15 coincide with the target surface 5.

Next, when the result of the determination in step S300 or S310 is NO or when the processing of step S320 is ended, whether or not the work type has changed to the intra-target work is then determined (step S330). In addition, when a result of the determination in step S330 is YES, whether or not the work tool state is the soil filled state is determined (step S340).

When a result of the determination in step S340 is NO, that is, when the work type has changed to the intra-target work and the work tool state is not the soil filled state, the "claw tip position designating mode" is read out from the work tool operation form storage section 53 and set as an operation form (step S341).

A state in which the work type has changed to the intra-target work can be considered to be a state in which the work is being performed within the work area 7. In addition, at this time, when the work tool state is not the soil filled state, it can be determined that it is a working status in which excavation is to be performed within the work area. That is, it is possible to determine, on the basis of the determinations in steps S330 and S340, whether or not an assisting operation appropriate for the present working status is the "claw tip position designating mode," which is the operation form in which the position of the bucket 15 is controlled to make the claw tip of the bucket 15 coincide with the target surface 5. Incidentally, when the result of the determination in step S340 is YES, that is, when the work tool state is the soil filled state, it can be estimated that the work of strewing soil, such as laying and leveling of the soil, is performed within the work area 7, and therefore, such control that makes the claw tip of the bucket 15 coincide with the target surface 5 is not performed.

Next, when the result of the determination in step S330 is NO, when the result of the determination in step S340 is YES, or when the processing of step S341 is ended, whether or not the work type has changed to the target leaving work is then determined (step S350). When a result of the determination in step S350 is YES, the bucket posture maintaining mode is cancelled (step S360), and the claw tip position designating mode is cancelled (step S370).

A state in which the work type has changed to the target leaving work is a state in which the bucket 15 is to leave the work area 7, and can be determined to be a working status in which the operator of the hydraulic excavator 1 intends to make a transition to the work at a place separated from the target surface 5. That is, it is possible to determine, on the basis of the determination in step S350, whether or not to cancel the assisting operation for work on the target surface 5.

Next, when the result of the determination in step S350 is NO or when the processing of steps S360 and S370 is ended, whether or not the work type is one of the extra-target work and the intra-target work is then determined (step S380). In addition, when a result of the determination in step S380 is YES, whether or not the work tool state has changed to the soil filled state is next determined (step S390).

When a result of the determination in step S390 is YES, that is, when the work type is the extra-target work or the intra-target work and the work tool state has changed to the soil filled state, the "bucket horizontal maintaining mode" is read out from the work tool operation form storage section 53 and set as an operation form (step S400).

A state in which the work tool state has changed to the soil filled state at a position separated from the target surface 5 in the case of the extra-target work or within the work area in the case of the intra-target work can be determined to be a working status in which transportation is started after soil is excavated. That is, it is possible to determine, on the basis of the determinations in steps S380 and S390, whether or not to set the "bucket horizontal maintaining mode," which is the operation form in which the angle of the bucket 15 is controlled so as to hold the opening plane of the bucket 15 horizontal.

Next, when the result of the determination in step S380 or S390 is NO or when the processing of step S400 is ended, whether or not the work tool state is the soil filled state is next determined (step S410). In addition, when a result of the determination in step S410 is YES, whether or not the work type has changed to one of the intra-target work and the extra-target work is next determined (step S420).

When a result of the determination in step S420 is YES, that is, when the work tool state is the soil filled state and the work type is the intra-target work or the extra-target work, the bucket horizontal mode is cancelled (step S430). The processing is then ended. In addition, the processing is ended when the result of the determination in either step S410 or S420 is NO.

A state in which the work tool state is the soil filled state and the work type has changed to the intra-target work or the extra-target work can be determined to be a working status in which soil has been transported to a position separated from the target surface 5 within the work area 7 or to above the target surface 5 outside the work area 7. That is, it is possible to determine, on the basis of the determinations in steps S410 and S420, whether or not to cancel the bucket horizontal maintaining mode to enable a soil discharge operation.

Next, computation processing in the work tool operation correction amount computing section 56 will be described. The work tool operation correction amount computing section 56 computes a control amount (operation correction amount) to perform the assisting operation, on the basis of the computation result from the work tool position and posture computing section 50, the settings made by the work target setting section 51, the work type invoked by the work tool operation form invoking section 55, and the operation state of the operation button 25.

Figure 19:
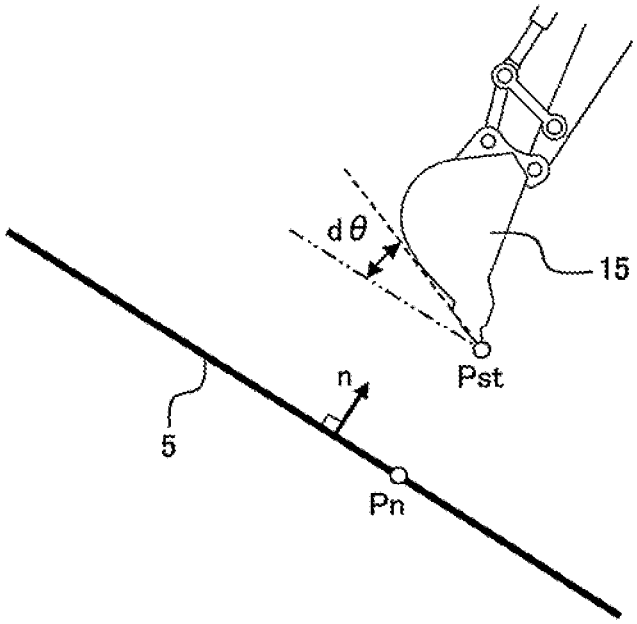
FIG. 19 is a diagram of assistance in explaining a method of computing a bucket assisting operation amount and illustrates, in perspective, the relation between the bucket and a target surface.

FIG. 19 is a diagram of assistance in explaining a method of computing a bucket assisting operation amount and illustrates, in perspective, the relation between the bucket and the target surface.

The work tool operation correction amount computing section 56 first calculates a point Pn on the target surface 5 that is the closest to a distal end position Pst of the bucket 15, by using (Equation 9) below.

$$Pn=Ptl-n\cdot(Pst-Pt1)/|n|\hat{}2\times n \quad \text{(Equation 9)}$$

Incidentally, "|n|" in the above (Equation 9) represents the norm of a vector.

In addition, an angular difference dθ between the angle θst of the bottom surface of the bucket 15 with respect to the horizontal plane and the angle of the target surface 5 or the horizontal is computed. With this, a movement correction speed vadj for the distal end position Pst of the bucket 15 is calculated by (Equation 10) below by using predetermined gains Kadjp and Kadjθ.

$$vadj=[Kadjp\times(Pst-Pn),Kadj\theta\times d\theta]\hat{}T \quad \text{(Equation 10)}$$

Then, each swing angular velocity of the hydraulic excavator 1 is computed by converting the movement correction speed vadj. In addition, when a Jacobian matrix J corresponding to the relations between (Equation 1) to (Equation 3) is used, a correction swing angular velocity ωadj of the hydraulic excavator 1 can be expressed as in (Equation 11) and (Equation 12) below by using the speed vadj of the distal end position Pst of the bucket 15.

$$J(q)=\partial F(q)/\partial q \quad \text{(Equation 11)}$$

$$\omega adj=(J(q)\hat{}-1)\times vadj \quad \text{(Equation 12)}$$

Then, the work tool operation correction amount computing section 56 selects an actuator(s) to which ωadj is to be applied, on the basis of the setting made by the work tool operation form invoking section 55. For example, in the bucket horizontal maintaining mode or the bucket posture maintaining mode for correcting the posture of the bucket only a component of ωadj related to rotation of the bucket 15 is extracted. In the claw tip position designating mode, only components of ωadj related to rotation of the boom 13 and the arm 14 are extracted. In addition, ωadj is set to 0 (zero) when the operation button is depressed, so that the assisting operation is forcibly prevented from being performed when the hydraulic excavator 1 performs an operation different from an intention of the operator.

The work implement control amount computing section 57 computes and outputs current commands (driving signals) for driving the control valves 34, 35, 36, and 37, the hydraulic pump 39, and the bleed-off unit 43, on the basis of an operation instruction amount indicated by the operation signal output from the control lever 24 and of the correction swing angular velocity ωadj output by the work tool operation correction amount computing section 56. That is, the work implement control amount computing section 57 converts the operation amount of the control lever 24 into a swing angular velocity command value ωope of the hydraulic excavator 1 which is proportional to the operation amount, and calculates a current command Cctrl by (Equation 13) below by using the correction swing angular velocity ωadj and a predetermined conversion map Kctrl(q) of swing angular velocity and the current command.

$$Cctrl=Kctrl(q)\times(\omega ope+\omega adj) \quad \text{(Equation 13)}$$

Next, a method of displaying the state of the assisting operation to the operator will be described.

Figure 20:
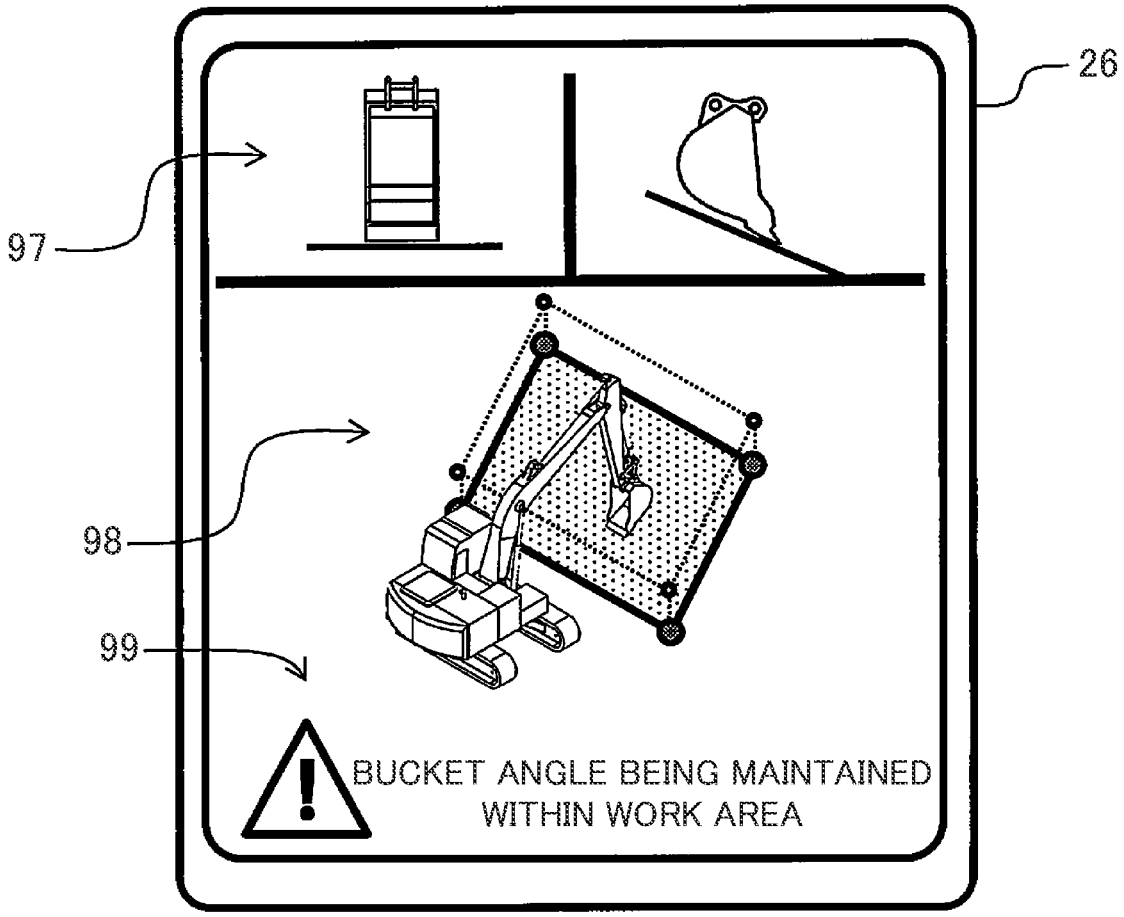
FIG. 20 is an external view illustrating a bucket state display during an assisting operation.

FIG. 20 is an external view illustrating a bucket state display during the assisting operation. The controller 23 displays a bucket state display 97 and an excavator state display 98 as well as an assisting operation contents display 99 on the display input device 26. The bucket state display 97 includes a front view and a side view of the bucket 15 for indicating the positional relation between the bucket 15 and the target surface 5. The excavator state display 98 includes a bird's-eye view of the hydraulic excavator 1 for indicating the positional relation between the hydraulic excavator 1 and the target surface 5. The controller 23 thus notifies a result of the estimation of the working status and the contents of the assisting operation to the operator of the hydraulic excavator 1. In such a manner, the working status of the hydraulic excavator 1 is determined, and the assisting operation form is changed to control the assisting operation. Accordingly, it is possible to perform an appropriate operation of the bucket according to the work contents and the work target of the hydraulic excavator 1, thereby improving the work accuracy.

Effects of the present embodiment configured as described above will be described.

In order to achieve appropriate operation assistance in MC, it is necessary to switch between the enabling and disabling of MC according to the work contents and a work environment and set appropriate assistance contents. In the conventional technology, the operator alternately selects the enabling and disabling of the automatic control by operating the operating member provided to the control lever. In such a case, however, if the operator forgets to operate the operating member, work may be performed while the automatic control is disabled. Consequently, excavation may possibly be performed beyond a design surface. In addition, when the work contents are set through an operation made by the operator, if the operator sets the work contents or the assistance contents erroneously, the work device may not be set in a desired posture. As a result, the work device may erroneously excavate a construction surface excessively or drop the soil transported to the construction surface, so that sufficient work accuracy may not be obtained. For example, in work of shaping the terrain profile of a construction object into a desired shape, a shaping operation and a transporting operation may alternately be performed. In the shaping operation, while the position and posture of the bucket are adjusted, the hydraulic excavator 1 excavates soil with the bottom surface of the bucket made to coincide with the construction surface to be shaped. In the transporting operation, while the bucket opening plane is kept parallel to the horizontal plane so as not to drop soil onto the shaped surface, the hydraulic excavator 1 moves the soil that becomes a surplus during the shaping. In the shaping work where the automatic control is performed such that the posture of the bucket corresponds to a predetermined angle, if the operating member is operated erroneously and the automatic control of the shaping operation and the transporting operation is performed conversely, the bucket may not be set in a desired posture. As a result, the hydraulic excavator 1 may erroneously excavate the construction surface excessively or drop the transported soil onto the construction surface, so that sufficient work accuracy may not be obtained. That is, in such a case as described above, an appropriate MC operation may be unable to be performed, and thus, the work accuracy may be decreased.

On the other hand, in the present embodiment, the work machine (hydraulic excavator 1) includes the lower track structure 10; the upper swing structure 11 that is swingable with respect to the lower track structure 10; the articulated front work implement 12 that is attached to the upper swing structure 11 and includes a plurality of front implement members (the boom 13, the arm 14, and the bucket rotatably coupled together; the operation device (control lever 24) that outputs operation signals for driving the upper swing structure 11 and the front work implement 12 according to amounts of operations made by the operator; a plurality of front work implement actuators (the boom cylinder 17, the arm cylinder 18, and the bucket cylinder 19) that individually drive the plurality of front implement members on the basis of driving signals generated according to the operation signals output from the operation device; the swing actuator (swing hydraulic motor 16) that swing-drives the upper swing structure 11 on the basis of the operation signal output from the operation device; the posture information sensor (inertial measuring devices 27 to that senses posture information as information regarding the postures of the upper swing structure 11 and the front work implement 12; and the controller (controller 23) that performs the operation correction control to output a driving signal to at least one of the plurality of front work implement actuators such that the front work implement 12 is set in a predetermined position or posture on the predetermined target surface 5 and within one area with respect to the target surface, on the basis of the operation signals output from the operation device and the posture information sensed by the posture information sensors. The work machine further includes the load information sensor (pressure sensors 32 and 33) that senses load information as information regarding a load on at least one of the plurality of front work implement actuators, and a work area setting device (display input device 26) that sets the work area 7 over the predetermined target surface 5. The controller determines a working status indicating a status related to the present work of the work machine, on the basis of the operation signals output from the operation device, the posture information sensed by the posture information sensor, the load information sensed by the load information sensor, and the work area set by the work area setting device, decides an operation form indicating contents of an operation in the operation correction control of the front work implement, from a plurality of operation forms set in advance, according to the determined working status, and performs the operation correction control such that the front work implement moves according to the operation form. It is thus possible to perform an appropriate assisting operation in machine control and consequently improve the work accuracy.

Second Embodiment

A second embodiment of the present invention will be described with reference to FIG. 21 and FIG. 22.

The present embodiment represents a case where a rotary tilt bucket 44 is used in place of the bucket 15 used as a work tool in the first embodiment.

Figure 21:
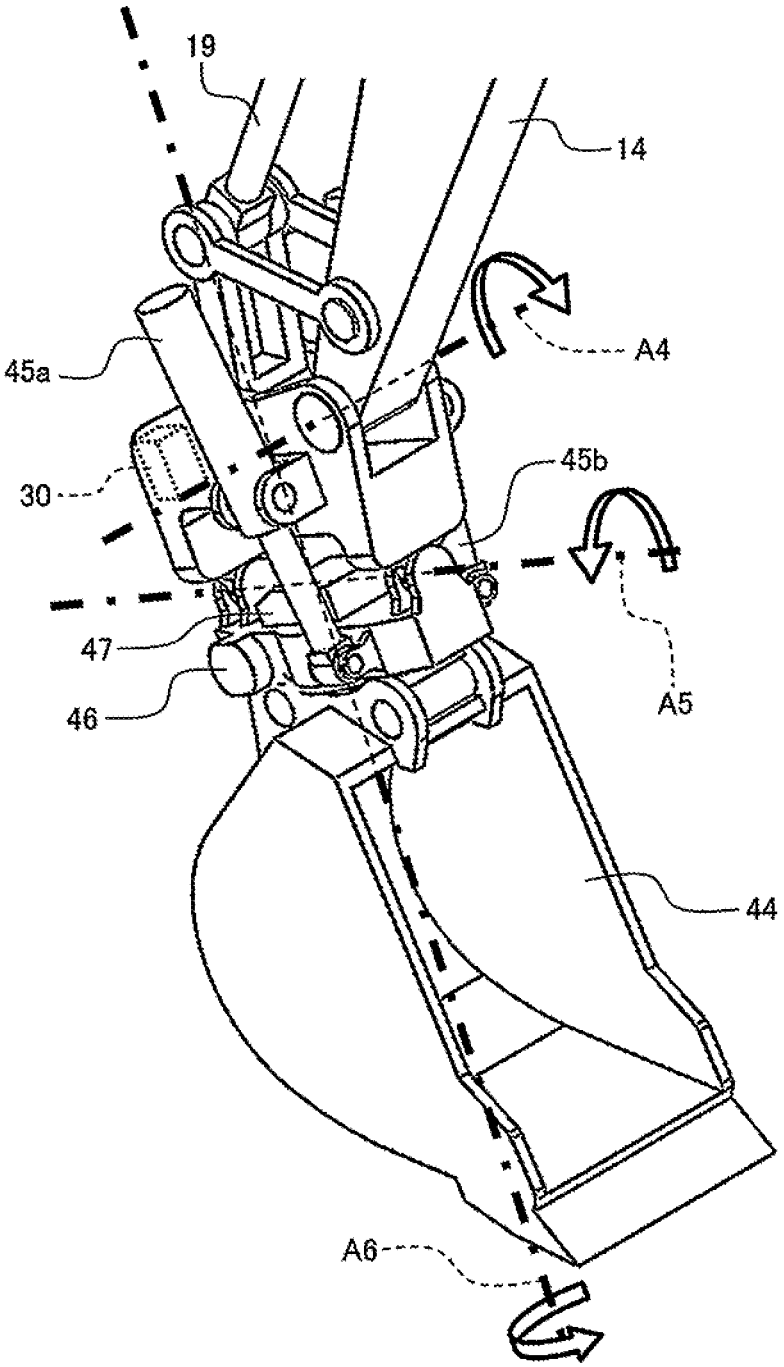
FIG. 21 is a diagram illustrating a rotary tilt bucket on an enlarged scale.

FIG. 21 is a diagram illustrating the rotary tilt bucket on an enlarged scale. In FIG. 21, members similar to those of the first embodiment are identified by the same reference signs, and description thereof will be omitted.

In FIG. 21, the rotary tilt bucket 44 is provided to the distal end of the arm 14, which is a front implement member of the front work implement 12, rotatably about a rotational axis A4. In addition, the rotary tilt bucket 44 is rotatable about each of two rotational axes, i.e., a rotary rotational axis A6 and a tilt rotational axis A5, which are perpendicular to the rotational axis A4 with respect to the front work implement 12. The rotary rotational axis A6 and the tilt rotational axis A5 are perpendicular to each other. The rotary tilt bucket 44 includes a rotation motor 46 as a rotary actuator that rotationally drives the rotary tilt bucket 44 about the rotational axis A6, and tilt cylinders 45*a* and 45*b* as tilt actuators that rotationally drive the rotary tilt bucket 44 about the rotational axis A5. That is, the rotary tilt bucket 44 is rotated about the rotational axis A4 at the distal end of the arm 14 by the bucket cylinder 19, rotated about the rotational axis A5 orthogonal to the rotational axis A4 by the tilt cylinders 45*a* and 45*b* at a coupling member of the rotary tilt bucket 44, and rotated about the rotational axis A6 orthogonal to the rotational axes A4 and A5 by the rotation motor 46 at a coupling member of the rotary tilt bucket 44.

A rotational angle meter 47 which is a posture information sensor is attached to the rotary tilt bucket 44 and is capable of sensing a rotational angle (rotary angle) of the rotary tilt bucket 44 about the rotational axis A6. In addition, an inertial measuring device 30 which is a posture information sensor can sense a rotational angle (tilt angle) about the rotational axis A5 in addition to a rotational angle about the rotational axis A4. That is, the orientation of the rotary tilt bucket 44 can be calculated on the basis of sensing results from the inertial measuring device 30 and the rotational angle meter 47.

In such a work machine, the position and posture of the rotary tilt bucket can be adjusted independently with three degrees of freedom with respect to the machine body of the hydraulic excavator 1, so that complex operations can be performed. With such a hydraulic excavator 1, the operation form of the work tool in the work tool operation form setting section 52 is not limited to the posture of the bucket 15 and the position of the claw tip as illustrated in the first embodiment, and, for example, a plurality of postures of the rotary tilt bucket 44 about the A5 axis and the A6 axis can be set individually, together with the direction in which the rotary tilt bucket 44 moves and the posture of the rotary tilt bucket 44 about the A4 axis.

Figure 22:
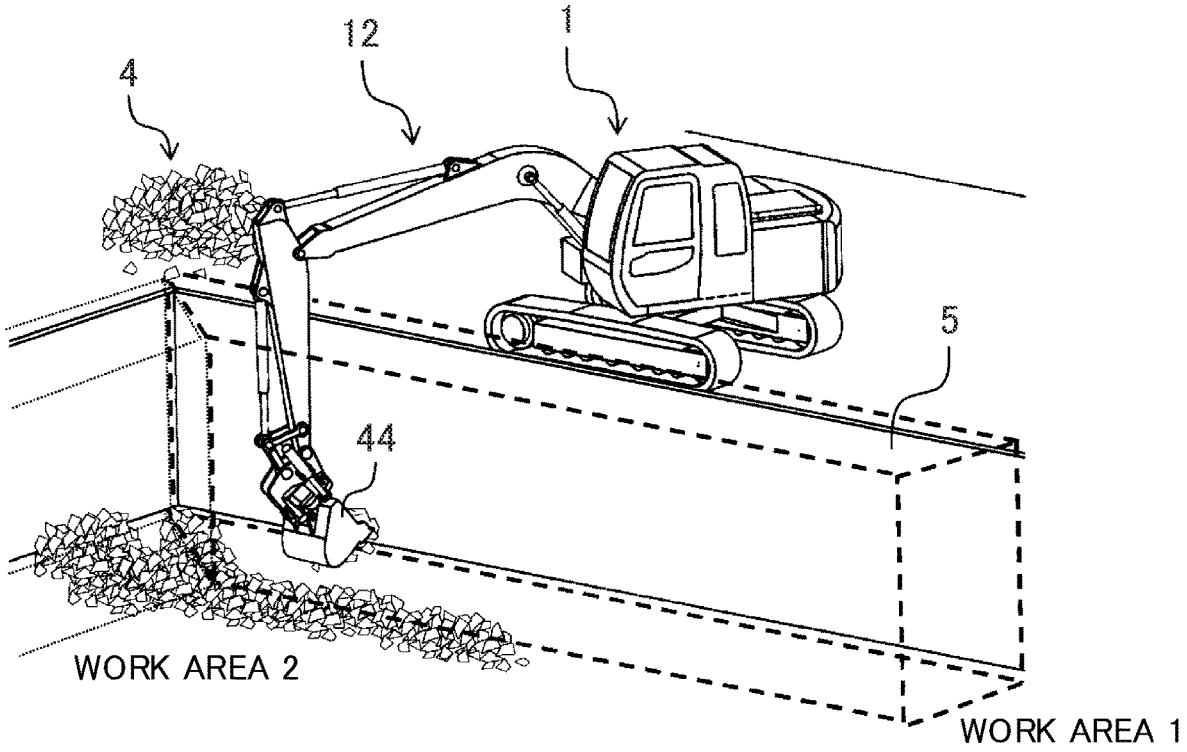
FIG. 22 is an overview diagram illustrating an example of work of a hydraulic excavator provided with the rotary tilt bucket.

FIG. 22 is an overview diagram illustrating an example of work of the hydraulic excavator provided with the rotary tilt bucket.

FIG. 22 illustrates an example of laying and leveling work. In the laying and leveling work, the hydraulic excavator 1 slightly drops the soil scooped from the stock 4 onto a ground at the bottom of a retaining wall with the use of the rotary tilt bucket 44, and thus uniformly strews the soil. At this time, in order to strew the soil uniformly in the vicinity of a vertical wall surface, it is preferable that the target surface 5 be set at an appropriate distance from the wall surface and that the rotary tilt bucket 44 be movable in a state of facing the target surface 5 while turning in a direction perpendicular to a direction in which the rotary tilt bucket 44 is facing the target surface 5. The operation form of the work tool in the work tool operation form setting section 52 may be set as described above.

In addition, the working status determining section 54 may determine the working status by a different method. For example, the working status may be computed by using a reaction force acting on the rotary tilt bucket 44, on the basis of the posture of the front work implement 12 and thrusts of the respective cylinders, the thrusts being computed on the basis of the pressures of the boom cylinder 17, the arm cylinder 18, and the bucket cylinder 19. Needless to say, a result of estimation of a payload of the soil within the rotary tilt bucket 44 may also be used.

In addition, the combination of the work area and the work tool operation form that are set by the work target setting section 51 and the work tool operation form setting section 52 is not limited to only one combination as in the first embodiment. For example, as in the laying and leveling work performed by the hydraulic excavator 1 provided with the rotary tilt bucket 44 illustrated in FIG. 22, the work area may be set for each retaining wall, and the assisting operation may be performed in different operation forms.

Incidentally, an example has been described above in which the work implement control amount computing section 57 calculates the current command Cctrl by using the conversion map Kctrl(q) of the swing angular velocity and the current command. However, it is needless to say that the current command Cctrl may be computed by a different method and that the control command may be generated by using a map that uses a pressure of the hydraulic circuit or a control law of model predictive control or the like.

The other configurations are similar to those of the first embodiment.

The present embodiment configured as described above can also provide effects similar to those of the first embodiment.

<Supplementary Notes>

It is to be noted that the present invention is not limited to the foregoing embodiments and includes various modifications and combinations of embodiments within a scope not departing from the spirit of the present invention. Further, the present invention is not limited to those including all of the configurations described in the foregoing embodiments and also includes those from which some of the configurations are omitted. In addition, a part or the whole of each of the configurations, the functions, and the like described above may be implemented by, for example, being designed in an integrated circuit or the like. Moreover, each of the configurations, the functions, and the like described above may be implemented by software causing a processor to interpret and execute a program for implementing the respective functions.

DESCRIPTION OF REFERENCE CHARACTERS

1: Hydraulic excavator
3: Groove
4: Stock
5: Target surface
6: Material
7: Work area
10: Lower track structure
11: Upper swing structure
12: Front work implement
13: Boom
14: Arm
15: Bucket
16: Swing hydraulic motor
17: Boom cylinder
18: Arm cylinder
19: Bucket cylinder
22: Operation room
23: Controller
24: Control lever
25: Operation button
26: Display input device
27 to 30: Machine body inertial measuring device
31: GNSS antenna
32, 33: Pressure sensor
34 to 37: Control valve
37*a*: Directional control valve
37*b*: Solenoid proportional pressure reducing valve
37*c*: Solenoid proportional pressure reducing valve
39: Hydraulic pump
40: Pilot pump
41: Prime mover
42: Hydraulic operating fluid tank
43: Bleed-off unit
44: Rotary tilt bucket
45*b*: Tilt cylinder
46: Rotation motor
47: Rotational angle meter
50: Work tool position and posture computing section
51: Work target setting section
52: Work tool operation form setting section
53: Work tool operation form storage section
54: Working status determining section
55: Work tool operation form invoking section
56: Work tool operation correction amount computing section
57: Work implement control amount computing section
90: Work target display
91: Work area adjustment display
92: Intra-work area bucket setting screen
93: Adjustment display
94: Bucket posture adjustment display
95: Confirmation button
96: Return button
97: Bucket state display
98: Excavator state display
99: Assisting operation contents display
A4: Rotational axis
A5: Tilt rotational axis
A6: Rotary rotational axis

The invention claimed is:

1. A work machine comprising:

a lower track structure;

an upper swing structure that is swingable with respect to the lower track structure;

an articulated front work implement that is attached to the upper swing structure and includes a plurality of front implement members rotatably coupled together;

an operation device that outputs operation signals for operating the upper swing structure and the front work implement according to amounts of operations made by an operator;

a plurality of front work implement actuators that individually drive the plurality of front implement members on a basis of driving signals generated according to the operation signals output from the operation device;

a swing actuator that swing-drives the upper swing structure on a basis of the operation signal output from the operation device;

a posture information sensor that senses posture information as information regarding postures of the upper swing structure and the front work implement; and a controller that performs operation correction control to output a driving signal to at least one of the plurality of front work implement actuators such that the front work implement is set in a predetermined position or posture on a predetermined target surface and within one area with respect to the target surface, on a basis of the operation signals output from the operation device and the posture information sensed by the posture information sensor, the work machine further including a load information sensor that senses load information as information regarding a load on at least one of the plurality of front work implement actuators, and a display input device that displays information and receives an instruction from the operator, the controller is configured to:

set a work area over the target surface based on the instruction from the operator inputted to the display input device, determine a working status indicating a status related to present work of the work machine, on a basis of the operation signals output from the operation device, the posture information sensed by the posture information sensor, the load information sensed by the load information sensor, and the work area set by the controller based on the instruction, decide an operation form indicating contents of an operation in the operation correction control of the front work implement, from a plurality of operation forms set in advance, according to the determined working status, and perform the operation correction control such that the front work implement moves according to the operation form.

2. The work machine according to claim 1, wherein the controller is configured to determine the working status on a basis of a work type and a work tool state, the work type being a classification that indicates a state of work performed by the work machine and being set on a basis of a position, an operation direction, and the work area of the front work implement, the work tool state being a classification that indicates a state of a work tool that is one of the plurality of front implement members provided to a distal end of the front work implement and being set on a basis of a posture of the work tool with respect to the target surface and a load on the front work implement.

3. The work machine according to claim 2, wherein the controller is configured to:

define in advance, as the work type, extra-target work that indicates a state in which the front work implement operates outside the work area, target approaching work that indicates a state in which the front work implement moves from an outside of the work area to an inside of the work area and approaches the target surface, target vicinity work that indicates a state in which the front work implement operates within the work area, and target leaving work that indicates a state in which the front work implement separates from the target surface and moves from the inside of the work area to the outside of the work area, and determine the work type on a basis of a positional relation between the front work implement and the target surface, the operation direction of the front work implement with respect to the target surface, and the work area.

4. The work machine according to claim 2, wherein the front work implement includes the work tool that is one of the plurality of front implement members provided to the distal end of the front work implement and that is capable of being filled with soil, and the controller is configured to:

define in advance, as the work tool state, a work tool soil filled state that indicates whether or not soil is present within the work tool and a work tool posture state that indicates whether or not an angle of the work tool with respect to the target surface is within a range of a predetermined relative angle, and determine the work tool state on the basis of the posture of the work tool with respect to the target surface and the load on the front work implement.

5. The work machine according to claim 1, wherein the front work implement includes a work tool that is one of the plurality of front implement members provided to a distal end of the front work implement and that is capable of being filled with soil, and the controller is configured to:

define in advance, as a mode of the operation form, a posture maintaining mode in which a posture of the work tool with respect to the target surface is maintained to be a present posture, a horizontal maintaining mode in which the posture of the work tool with respect to the target surface is maintained to be horizontal, and a position designating mode in which a position of the work tool is made to coincide with the target surface, and perform the operation correction control such that the front work implement moves according to the operation form.

* * * * *